US010849382B2

(12) United States Patent
Weispfennig

(10) Patent No.: US 10,849,382 B2
(45) Date of Patent: Dec. 1, 2020

(54) ADAPTIVE APPAREL

(71) Applicant: Marvelle Weispfennig, Glenwood, MN (US)

(72) Inventor: Marvelle Weispfennig, Glenwood, MN (US)

( * ) Notice: Subject to any disclaimer, the term of this patent is extended or adjusted under 35 U.S.C. 154(b) by 0 days.

(21) Appl. No.: 16/131,882

(22) Filed: Sep. 14, 2018

(65) Prior Publication Data

US 2019/0082760 A1 Mar. 21, 2019

Related U.S. Application Data

(60) Provisional application No. 62/558,849, filed on Sep. 14, 2017.

(51) Int. Cl.

| | |
|---|---|
| ***A41F 15/00*** | (2006.01) |
| ***A41F 1/00*** | (2006.01) |
| ***A41C 3/00*** | (2006.01) |

(52) U.S. Cl.

CPC ..... *A41F 15/002* (2013.01); *A41C 3/00* (2013.01); *A41C 3/0064* (2013.01); *A41F 1/006* (2013.01)

(58) Field of Classification Search

CPC ..... A41C 3/00; A41C 3/0028; A41C 3/0057; A41C 3/0064

USPC ..... 450/86, 79, 58, 69

See application file for complete search history.

(56) References Cited

U.S. PATENT DOCUMENTS

| | | | | | |
|---|---|---|---|---|---|
| 1,272,427 | A * | 7/1918 | Haderlein | A61F 13/145 | 450/37 |
| 1,466,598 | A * | 8/1923 | Panes | A41C 3/00 | 450/79 |
| 4,289,137 | A * | 9/1981 | Dell | A41C 3/02 | 450/58 |
| 4,917,651 | A * | 4/1990 | Rainville | A41C 3/02 | 2/101 |
| 4,955,846 | A * | 9/1990 | Greenberg | A41C 3/0028 | 2/73 |
| 4,957,466 | A * | 9/1990 | Hopps | A41C 3/0057 | 2/113 |
| 5,011,452 | A * | 4/1991 | Kelly | A41C 3/0028 | 450/58 |
| 5,032,104 | A * | 7/1991 | Rainville | A41C 3/02 | 2/101 |
| 5,427,563 | A * | 6/1995 | Manning | A61F 7/02 | 2/73 |
| 5,873,768 | A * | 2/1999 | Fleischman-Ament | A41C 3/0057 | 2/73 |
| 5,968,003 | A * | 10/1999 | Sisson | A41C 3/0064 | 602/19 |

(Continued)

*Primary Examiner* — Gloria M Hale

(74) *Attorney, Agent, or Firm* — Lisa Lindquist

(57) ABSTRACT

A brassiere comprising a front panel comprising a top, a bottom, a first side and a second side, a first bra cup and a second bra cup, the top of the front panel coupled to a first strap and a second strap, wherein one of the first side and the second side of the front panel is a shorter side, a back panel coupled to the first shoulder strap and the second shoulder strap and at least one reopenable and reclosable lateral side closure formed by coupling a first end region of the at least one short side to a second end region of the at least one back pane at a side of the wearer, the at least one second end region of the at least one back panel comprising at least one handle region.

16 Claims, 34 Drawing Sheets

(56) References Cited

U.S. PATENT DOCUMENTS

| | | | | |
|---|---|---|---|---|
| 6,253,424 | B1 * | 7/2001 | Rainville-Lonn | A41C 3/02 24/306 |
| 9,833,368 | B2 * | 12/2017 | Turner | A61G 7/015 |
| 2009/0075562 | A1 * | 3/2009 | Lung | A41C 3/0071 450/58 |
| 2011/0055994 | A1 * | 3/2011 | Chiaramonte | A41F 1/006 2/67 |
| 2012/0028541 | A1 | 2/2012 | Donnelly et al. | |
| 2012/0142253 | A1 * | 6/2012 | Javaid | A41C 3/04 450/80 |
| 2012/0220193 | A1 * | 8/2012 | Thompson | A41C 3/0064 450/93 |
| 2017/0318867 | A1 * | 11/2017 | Wiesman | A41C 3/0064 |

* cited by examiner

ADAPTIVE APPAREL

CROSS-REFERENCE TO RELATED APPLICATIONS

This application claims the benefit of priority under 35 U.S.C. § 119 to U.S. Provisional Application Ser. No. 62/558,849, filed Sep. 14, 2017, the entirety of which is incorporated herein by reference.

TECHNICAL FIELD

The present disclosure pertains to adaptive clothing, namely, adaptive bras and adaptive active wear, and methods of making and using the adaptive bras.

BACKGROUND

Customarily, bras are configured of a unitary piece of material, either formed from a single piece or of multiple pieces sewn and interconnected together. The ends of the unitary piece of material are adapted to be joined together in secure engagement either at the middle of the back of the wearer or the center chest area of the wearer, between the bra cups. In either event, the typical bra has a pair of bra cups and a pair of straps, one connected near the top of each cup and extending over the shoulder of the wearer and interconnected at the back portion of the bra.

When the wearer has medical conditions such as from a mastectomy, stroke, surgery on the neck, shoulder or the like, amputation (e.g. hand or arm), arthritis, and so forth, decreasing movement in one or the other of the arms, it can hinder placement of the bra over the shoulder and neck region. Accordingly, there is a need in the art for a therapeutic bra that may be easily placed over the shoulder and neck with the use of only one arm, for example.

BRIEF SUMMARY

This disclosure provides design, material, manufacturing method, and use alternatives for adaptive bras.

In one aspect, the present disclosure relates to a brassiere comprising first and second bra cups, each of said cups including upper, lower, inner side and outer side margins, a chest band connecting said inner side margins of said first and said second bra cup in the front of a wearer, first and second shoulder straps for coupling to the first and second bra cups respectively, a back band that couples to the first and second shoulder straps and to the first and second bra cups, the back band having a first end region, a first short side band that is coupled to at least one of the outer side margins of the first and second bra cups, the first short side band having a first end region, and a first reopenable and reclosable lateral side closure formed by coupling the first end region of the first short side band the first end region of the at least one back band at a side of the wearer, the at least one first end region of the at least one back band comprising at least one handle region.

Alternatively or additionally to any of the embodiments above, the closure is hook and loop material.

Alternatively or additionally to any of the embodiments above, the at least one handle region comprises a finger loop adapted for pulling the back panel of the brassiere to engage the short side band of the at least one first end region.

Alternatively or additionally to any of the embodiments above, the brassiere further comprises at least two handle regions.

Alternatively or additionally to any of the embodiments above, the brassiere further comprises at least 3 handle regions comprises at least three finger loops.

Alternatively or additionally to any of the embodiments above, the brassiere further comprises a second short side band coupled to another of the outer side margins of the first and second bra cups, the second short side band having a first end region.

Alternatively or additionally to any of the embodiments above, the brassiere further comprises a second reopenable and reclosable later side closure formed by coupling the first end region of the second short side band to a second end region of the back band, the second reopenable and reclosable lateral side closure is at an opposite side of the wearer from that of the first reopenable and reclosable later side closure.

Alternatively or additionally to any of the embodiments above, the second end region of the back band comprises at least one handle region.

Alternatively or additionally to any of the embodiments above, the at least one handle region comprises a finger loop.

In another aspect, the present disclosure relates to a brassiere comprising a front panel comprising a top, a bottom, a first side and a second side, a first bra cup and a second bra cup, the top of the front panel coupled to a first strap and a second strap, wherein one of the first side and the second side of the front panel is a shorter side, a back panel coupled to the first shoulder strap and the second shoulder strap and at least one reopenable and reclosable lateral side closure formed by coupling a first end region of the at least one short side to a second end region of the at least one back panel at a side of the wearer, the at least one second end region of the at least one back panel comprising at least one handle region.

Alternatively or additionally to any of the embodiments above, the closure comprises a hook and loop material.

Alternatively or additionally to any of the embodiments above, the at least one handle region comprises a finger loop.

Alternatively or additionally to any of the embodiments above, the brassiere further comprises at least two handle regions.

Alternatively or additionally to any of the embodiments above, the brassiere further comprises at least three handle regions.

Alternatively or additionally to any of the embodiments above, the at least one handle region comprises at least one finger loop, the finger loop may be stationary or detachable.

In another aspect, the present disclosure relates to a brassiere comprising a front panel comprising a top, a bottom, a first side and a second side, a first bra cup and a second bra cup, the top of the front panel coupled to a first strap and a second strap, wherein one of the first side and the second side of the front panel is a short side and one of the first side and the second side is a long side, the long side of the front panel is coupled to the first shoulder strap and the second shoulder strap and at least one reopenable and reclosable lateral side closure formed by coupling a first end region of the at least one short side to a second end region of the at least one back panel at a side of the wearer, the at least one second end region of the at least one back panel comprising at least one handle region.

Alternatively or additionally to any of the embodiments above, the closure comprises a hook and loop material.

Alternatively or additionally to any of the embodiments above, the at least one handle region comprises a finger loop.

Alternatively or additionally to any of the embodiments above, the brassiere further comprises at least two handle regions.

Alternatively or additionally to any of the embodiments above, the brassiere further comprises at least three handle regions.

Alternatively or additionally to any of the embodiments above, the finger loop is adapted for pulling by a wearer's finger to couple the long side of the front panel to the short side of the front panel.

The above summary of some embodiments is not intended to describe each disclosed embodiment or every implementation of the present disclosure. The figures, and Detailed Description, which follow, more particularly exemplify these embodiments.

BRIEF DESCRIPTION OF THE DRAWINGS

The disclosure may be more completely understood in consideration of the following detailed description in connection with the accompanying drawings, in which.

Figure 1:
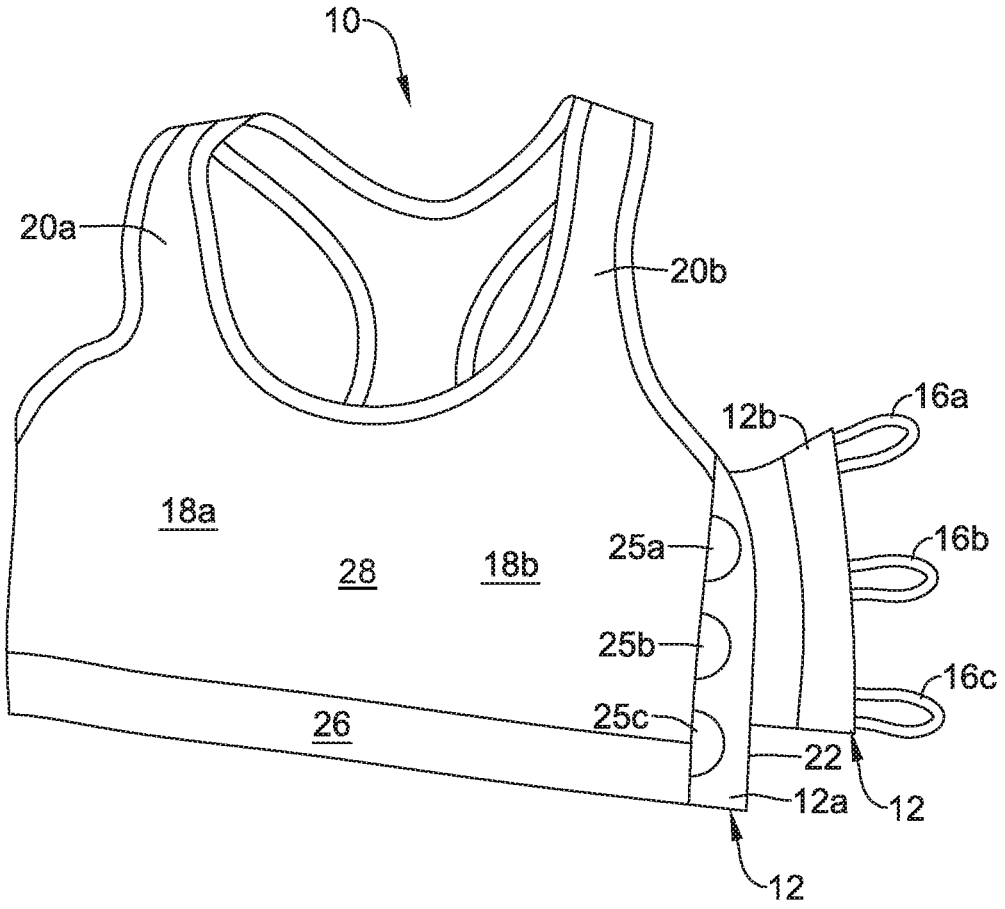
FIG. 1 is front view of an example bra.

While the disclosure is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure.

DETAILED DESCRIPTION

The following detailed description should be read with reference to the drawings in which similar elements in different drawings are numbered the same. The drawings, which are not necessarily to scale, depict illustrative embodiments and are not intended to limit the scope of the invention.

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (e.g., having the same function or result). In many instances, the terms "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include one or more particular features, structures, and/or characteristics. However, such recitations do not necessarily mean that all embodiments include the particular features, structures, and/or characteristics. Additionally, when particular features, structures, and/or characteristics are described in connection with one embodiment, it should be understood that such features, structures, and/or characteristics may also be used connection with other embodiments whether or not explicitly described unless clearly stated to the contrary.

The present disclosure relates to brassieres that are particularly adapted to be easily donned with a single hand or arm. These brassieres find particular utility for women who have had a mastectomy, a stroke, or other surgical procedure to the neck, shoulder, arm, hand or the like, amputation (e.g. hand or arm), arthritis, and so forth which make it difficult to don a brassiere. However, the brassieres and the features disclosed herein may find utility in any of a variety of applications including as athletic brassieres and the features disclosed herein may also find utility in swim apparel, for example, as well as any adaptive clothing for convalescent individuals. The brassieres disclosed herein have many beneficial features including, but not limited to, comfort and ease of donning.

Figure 2:
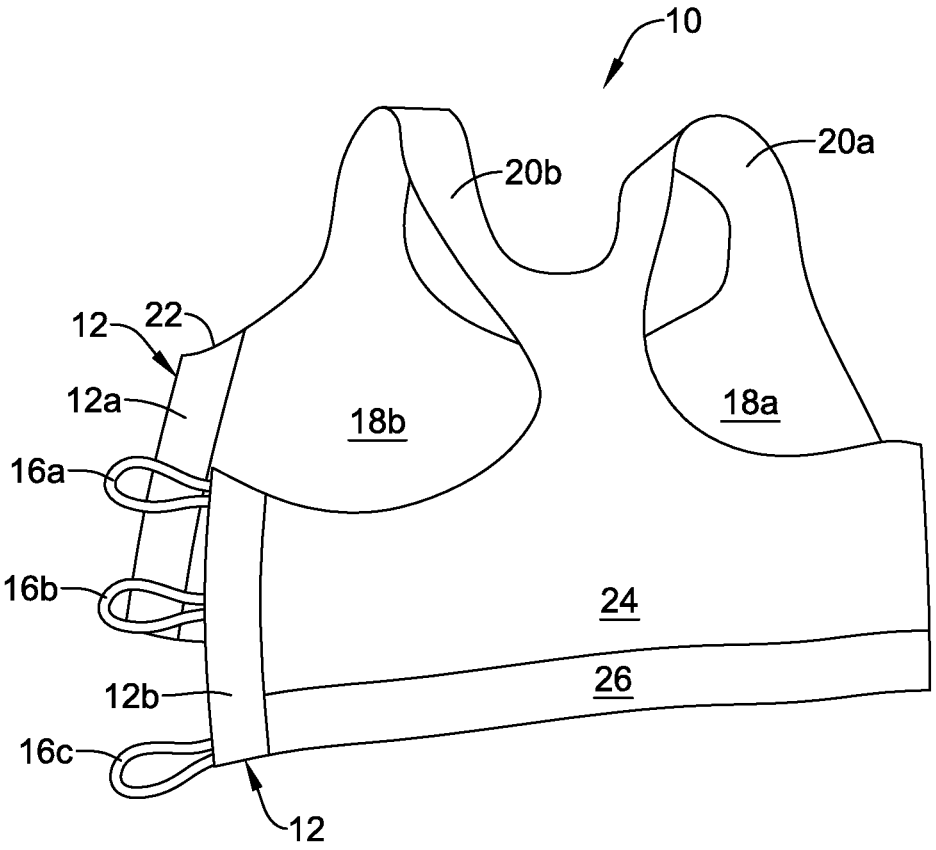
FIG. 2 is a back view of an example bra in accordance with that shown in FIG. 1.

Turning now to the figures, FIGS. 1 and 2 illustrate front and back views of an example brassiere, hereinafter bra 10. As shown in FIG. 1, bra 10 includes a first bra cup 18*a* and a second bra cup 18*b*, interconnected to a back band 24 as shown in FIG. 2 by shoulder straps 20*a* and 20*b* respectively.

Bra 10 includes a lateral adjustable closure 12, wherein a first portion 12*a* of the lateral adjustable closure 12 is interconnected to the long back band 24 and a second portion 12*a* of the lateral adjustable closure is interconnected to a short side band 22. Alternatively, the short side band 22 may be referred to as the first short side 22 of the front panel 28 of bra 10 and the long back band 24 may be referred to as the long side 24 of the front panel 28 of bra 10, wherein the bra 10 forms one continuous structure from the front panel 28 of bra 10 to the long back band 24 of bra 10. The first portion 12*a* of the lateral adjustable side closure 12 further includes a plurality of handle regions, in this embodiment three handle regions 16*a*, 16*b* and 16*c*, for example, in the form of finger holds or loops. The lateral adjustable closure 12 may be in a form wherein the first portion 12*a* and the second portion 12*b* each comprising a material that supports a strip of hook-and-loop fastener. Bra 10 further includes a lower band region 26, which may be relatively elastic and/or supportive, and may be made from, for example, a knit or woven material. For example, the lower band region 26 may be formed from a continuous piece of material that forms the bra cups 18*a* and 18*b*, as well as the shoulder straps 20*a* and 20*b*, the back band 24, and the short side band 22, and may have an elastic strip sewn therein. The long back band 26 may be referred to as the long side 26 of the back panel 24 of bra 10. Alternatively, the lower band 26 may be formed from a separate and more elastic material and/or supportive material that is further connected to the bra 10 by sewing, for example.

The bra 10 may further include fingertip grips 25*a*, 25*b*, 25*c*. In this embodiment, the fingertip grips 25*a*, 25*b*, 25*c* are shown secured to the first portion 12*a* of the lateral adjustable side closure 12. The fingertip grips 25*a*, 25*b*, 25*c* can aid in connecting the first portion 12*a* to the second portion 12*b* of the lateral adjustable side closure 12, as well as to aid in proper positioning of the first portion 12*a* in correspondence to the second portion 12*b* of the lateral adjustable side closure 12, for example, in proper position of the plurality of handle regions 16*a*, 16*b*, 16*c* which will correspond to the opposing fingertip grips 25*a*, 25*b*, 25*c*. The fingertip grips may be a raised or thickened lateral ridge, and may be formed from a polymeric material, for example, silicone.

In this embodiment, the bra 10 is shown with three fingertip grips 25*a*, 25*b*, 25*c* but, bra 10 may include one, two, three, four fingertip grips, and so forth.

The bra 10 may further include pockets (not shown) in them to hold molded cups in the pockets. This is useful for sports bras, push up bras, and swimsuits. This is also advantageous for women who have had a mastectomy to allow the option of adding a prosthesis or prostheses in the bra.

An exemplary method of donning an example bra will be explained in detail with respect to FIGS. 10A-10M below.

Figure 3:
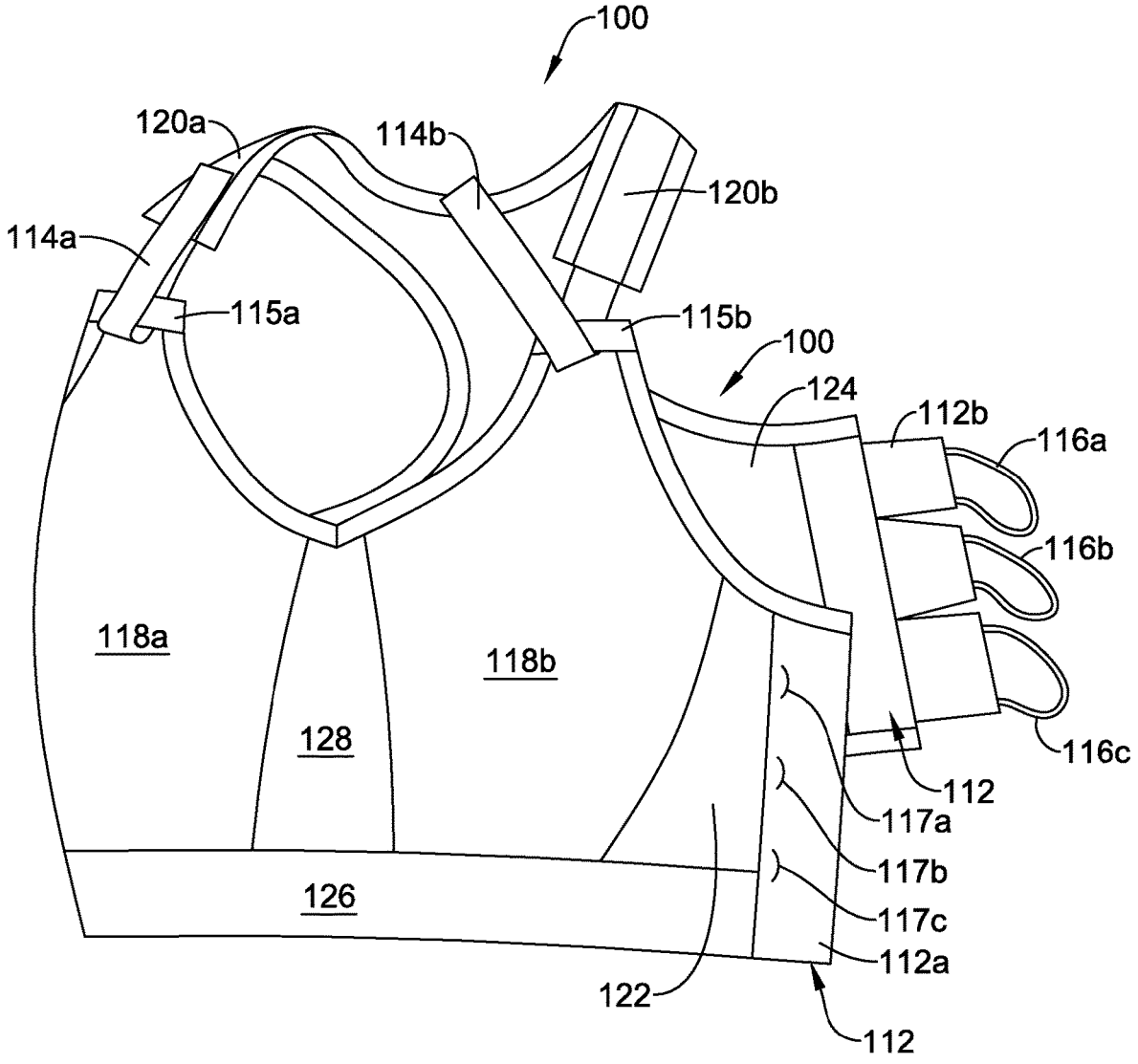
FIG. 3 is a front view of another example bra.
Figure 4:
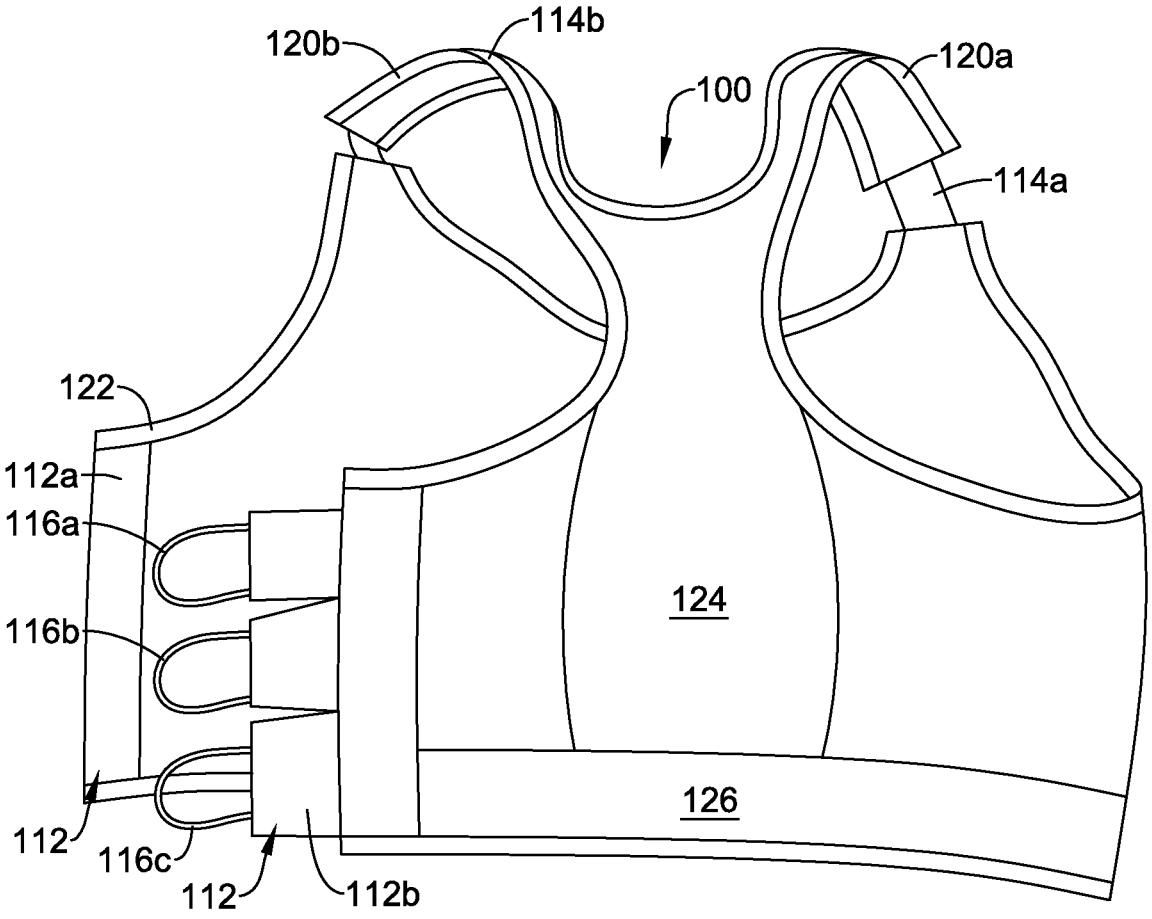
FIG. 4 is a back view of an example bra in accordance with that shown in FIG. 3.

FIGS. 3 and 4 illustrate front and back view of another exemplary bra 100. Bra 100 includes a first bra cup 118*a* and a second bra cup 118*b* interconnected to a back band 124 by a first adjustable shoulder strap 120*a* and a second adjustable should strap 120*b*. The first adjustable shoulder strap 120*a* includes a first strip 114*a* that comprises a strip of hook-and-loop fastener which extends through a first buckle 115*a* wherein the first strip 114*a* folds back upon itself to form the first adjustable shoulder strap 120*a*. Alternatively, the adjustable should straps 120*a*, 120*b* can be fed through button holes that are formed in the top of portion of the bra 100 as is known in the art. The second adjustable shoulder strap 120*b* includes a second strip 114*b* that comprises a strip of hook-and-loop fastener which extends through a second buckle 115*b* wherein the second strip 114*b* folds back upon itself to form the second adjustable shoulder strap 120*b*. The first bra cup 118*a* and the second bra cup 118*b* are interconnected by a middle band region 128 of a more elastic material, which may comprise the same material as the first and second bra cups 118*a*, 118*b* and comprise an elastic material sewn therein, or it may comprise a different yet more elastic material.

Bra 100 includes a lateral adjustable side closure 112, wherein a first portion 112*a* of the lateral adjustable side closure 112 is interconnected to the long back band 124 and a second portion 112*b* of the lateral adjustable side closure is interconnected to a short side band 122. The second portion 112*b* of the lateral adjustable closure 112 further includes a plurality of handle regions, in this embodiment three handle regions 116*a*, 116*b* and 116*c*, for example, in the form of finger holds or loops. Additionally, there may be finger grips or holds 117*a*, 117*b*, 117*c* added to the first portion 112*a* of the lateral adjustable side closure 112. In any of the embodiments disclosed herein, the bra 100 may include one, two, three, four, five or more handle regions as desired, and one, two, three, four, five or more finger grips as desired.

Figure 7:
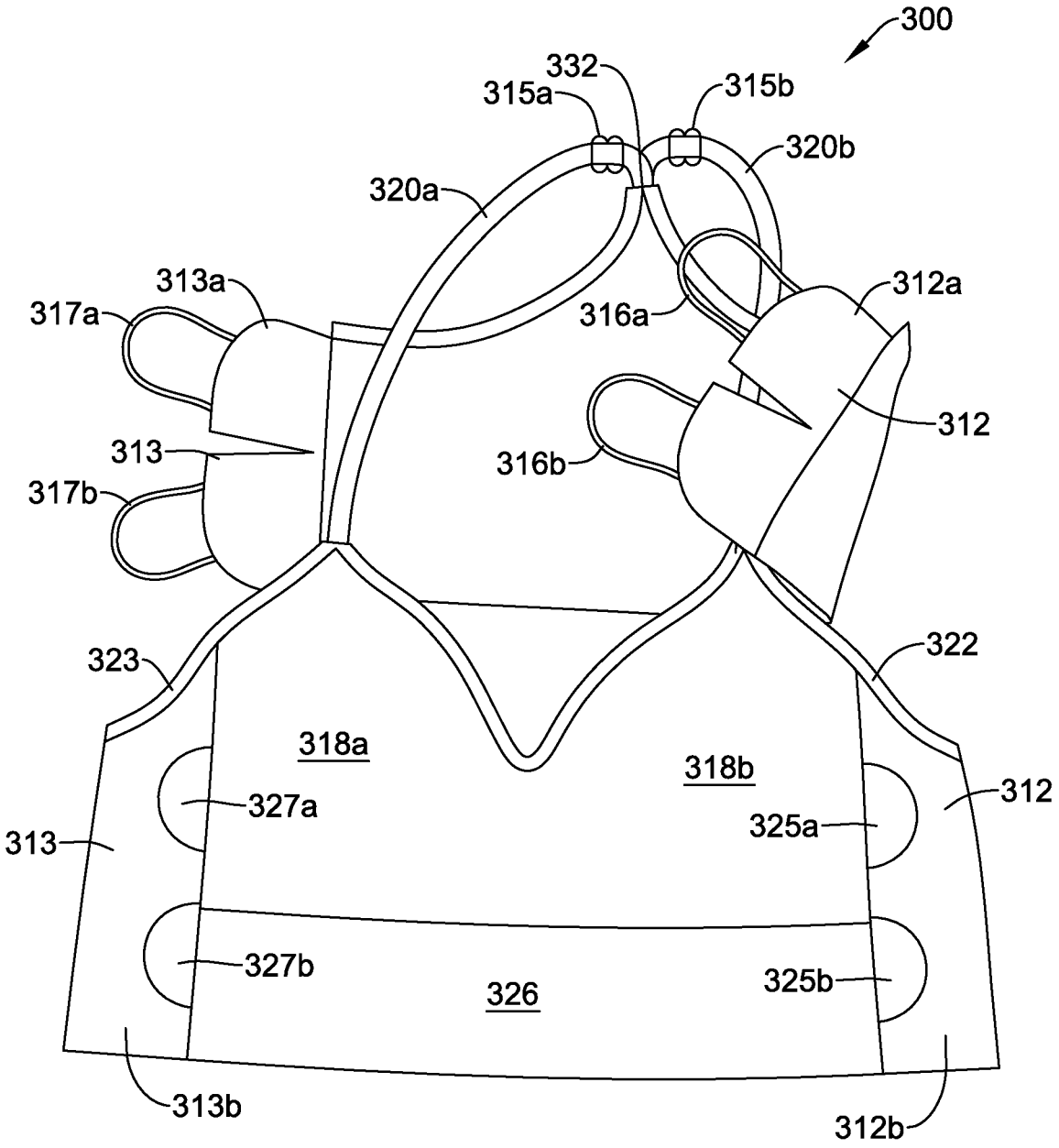
FIG. 7 is a front view of another example bra having dual adjustable lateral side closures.
Figure 8:
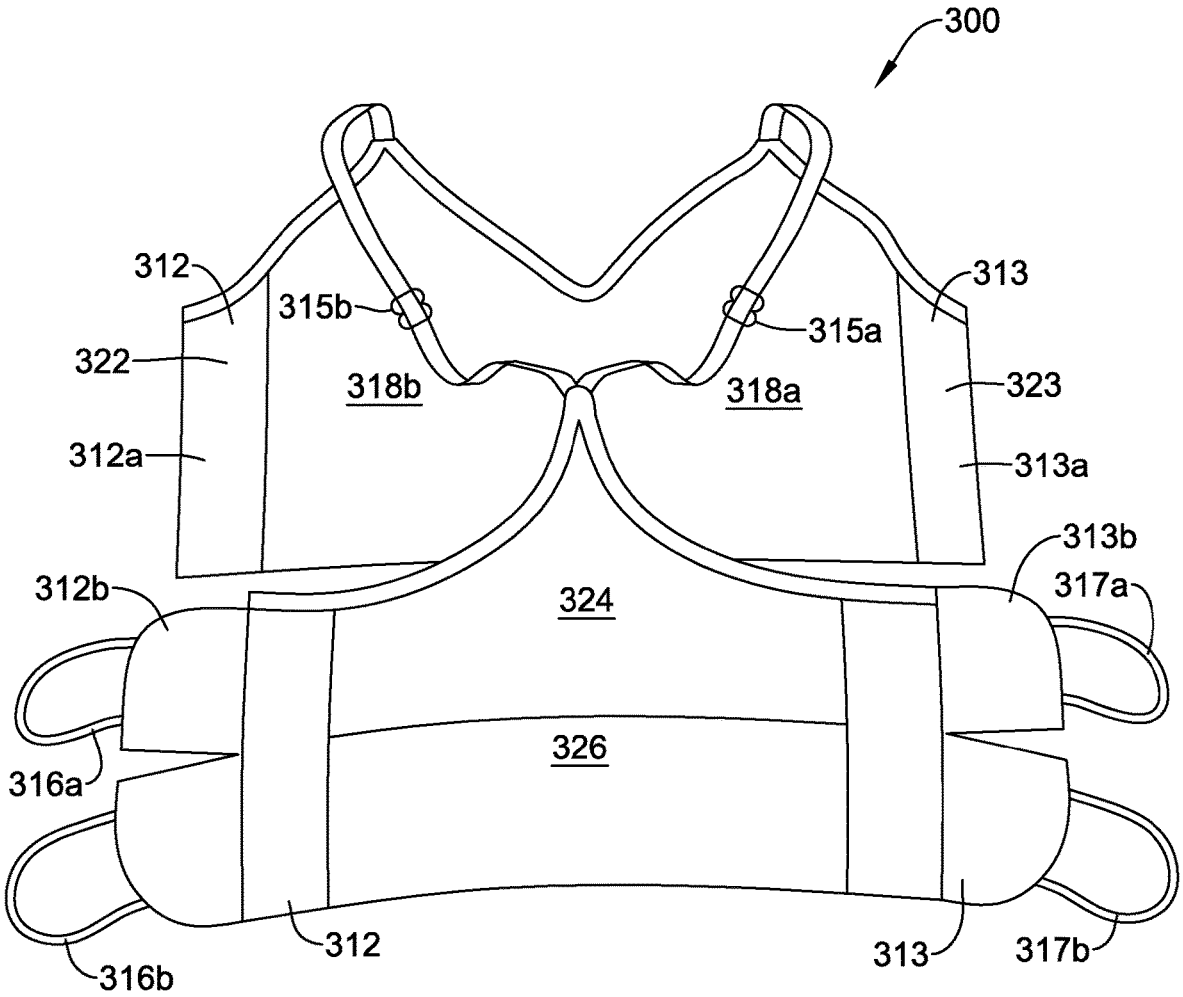
FIG. 8 is a back view of an example bra similar to that shown in FIG. 7.

The lateral adjustable side closure 112 may be in a form wherein the first portion 112*a* and the second portion 112*b* each comprise a material that supports a strip of hook-and-loop fastener. The lateral adjustable side closure 112 closes at a side of the wearer, in this example, the left side of the wearer. However the lateral adjustable side closure may close at the left side, the right side, or both sides of the wearer as illustrated in FIGS. 7 and 8 below.

Bra 100 further includes a lower band region 126, which may be relatively elastic. For example, the lower band region 126 may be formed from a continuous piece of material that forms the first and second bra cups 118*a* and 118*b*, as well as the first and second shoulder straps 120*a* and 120*b*, the back band 124, and the short side band 122, and may have an elastic strip sewn therein. The lower band region 126 may comprise the same material as the middle band region 124.

Figure 5:
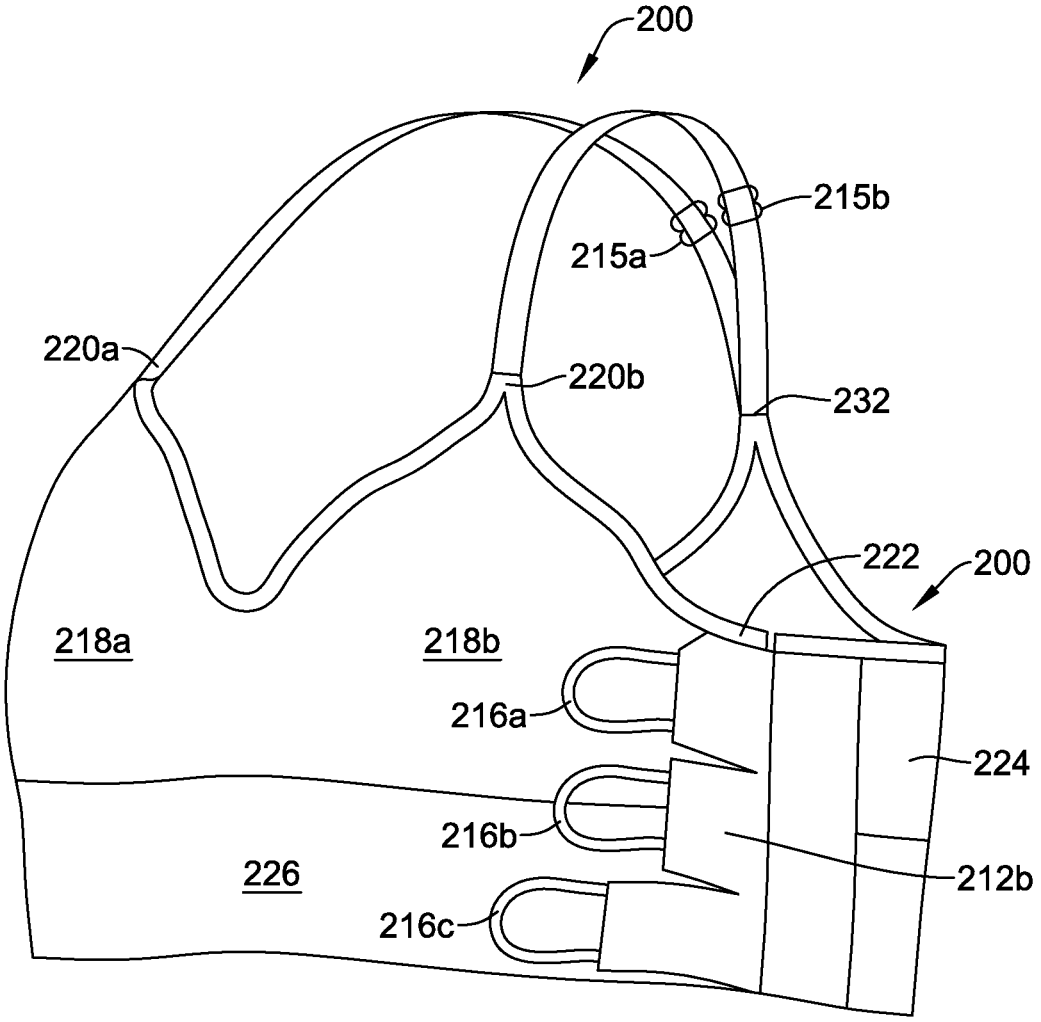
FIG. 5 is a front view of another example bra having a single adjustable lateral side closure.
Figure 6:
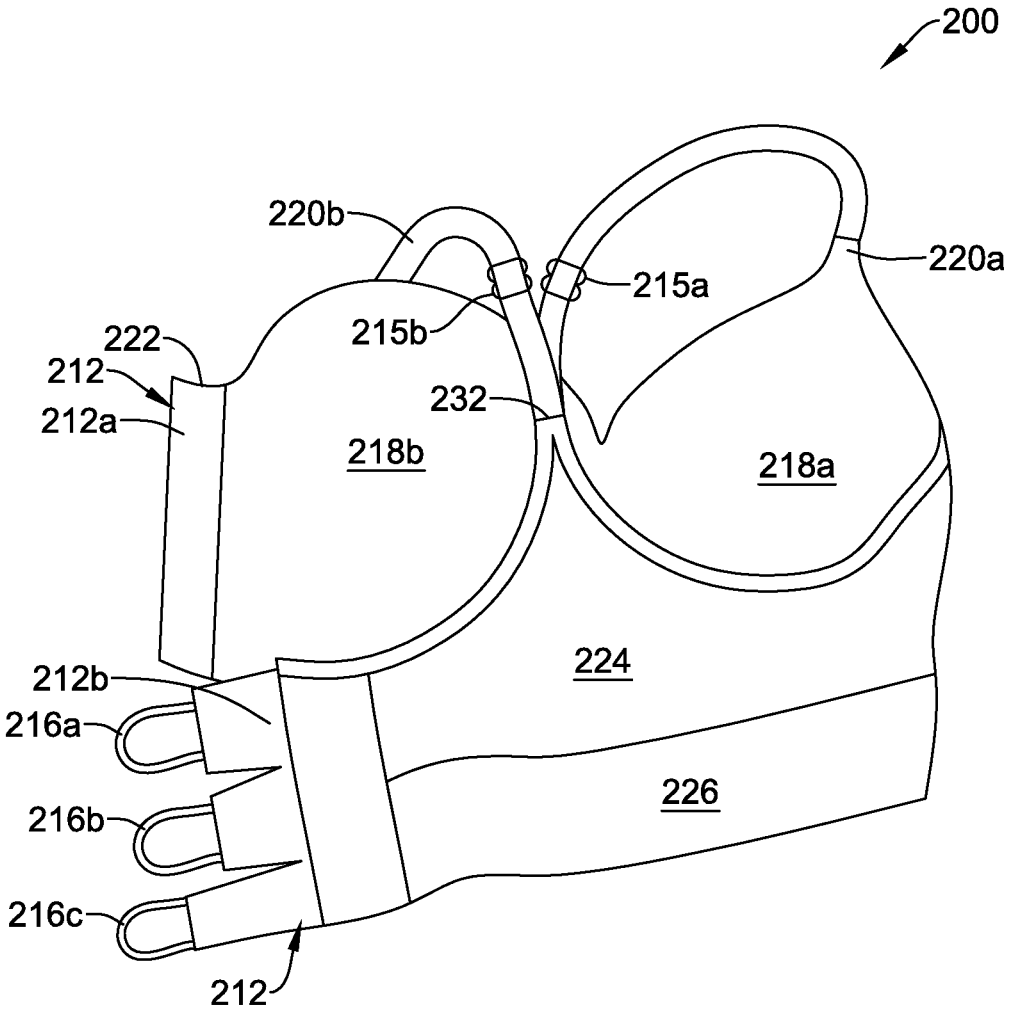
FIG. 6 is a back view of an example bra in accordance with that shown in FIG. 5.

FIGS. 5 and 6 illustrate front and back view of another exemplary bra 200. Bra 200 includes a first bra cup 218*a* and a second bra cup 218*b* interconnected to a back band 224 by a first adjustable shoulder strap 220*a* and a second adjustable should strap 220*b*. In this embodiment, the first adjustable shoulder strap 220*a* and the second adjustable shoulder strap 220*b* intersect the back band 224 at an intersection 232 wherein both of the first and second adjustable shoulder strap 220*a*, 220*b* are adjusted. While the first and second shoulder straps 220*a*, 220*b* are shown in this embodiment as being non-adjustably connected to the first and second bra cups 218*a*, 218*b* respectively, the first and second shoulder straps 220*a*, 220*b* may be adjustably connected to the first and second bra cups 218*a*, 218*b* respectively in addition to, or alternatively to the first and second shoulder straps 220*a*, 220*b* being adjustably connected at the intersection 232.

Bra 200 includes a lateral adjustable closure 212, wherein a first portion 212*a* of the lateral adjustable closure 212 is interconnected to the long back band 224 and a second portion 212*a* of the lateral adjustable closure is interconnected to a short side band 222. The first portion 212*a* of the lateral adjustable closure 212 further includes a plurality of handle regions, in this embodiment three handle regions 216*a*, 216*b* and 216*c*, for example, in the form of finger holds or loops. The lateral adjustable closure 212 may be in a form wherein the first portion 212*a* and the second portion 212*b* each comprise a material that supports a strip of hook-and-loop fastener. Bra 200 further includes a lower band region 226, which may be relatively elastic. For example, the lower band region 226 may be formed from a continuous piece of material that forms the first and second bra cups 218*a*, 218*b*, as well as the shoulder straps 220*a* and 220*b*, the back band 224, and the short side band 222, and may have an elastic strip sewn therein. The lower band region 226 may comprise the same material as the middle band region 224.

FIGS. 7 and 8 illustrate front and back view of another exemplary bra 300. Bra 300 includes a first bra cup 318*a* and a second bra cup 318*b* interconnected to a back band 324 by a first adjustable shoulder strap 320*a* and a second adjustable should strap 320*b*. In this embodiment, the first adjustable shoulder strap 320*b* and the second adjustable shoulder strap 320*a* intersect the back band 324 at an intersection 332 wherein both of the first and second adjustable shoulder strap 320*a*, 320*b* are adjusted. While the first and second shoulder straps 320*a*, 320*b* are shown in this embodiment as being non-adjustably connected to the first and second bra cups 318*a*, 318*b* respectively, the first and second shoulder straps 320*a*, 320*b* may be adjustably connected to the first and second bra cups 318*a*, 318*b* respectively in addition to, or alternatively to the first and second shoulder straps 320*a*, 320*b* being adjustably connected at the intersection 332.

Bra 300 includes a first lateral adjustable closure 312 and a second lateral adjustable closure 313. The lateral adjustable side closure 312 includes a first portion 312*a* of the lateral adjustable closure 312, which is interconnected to the long back band 324 and a second portion 312*a* of the lateral adjustable closure is interconnected to a short side band 322. The first portion 312*a* of the lateral adjustable closure 312 further includes a handle regions, in this embodiment two handle regions 316*a* and 316*b*, for example, in the form of finger holds or loops. The lateral adjustable closure 312 may be in a form wherein the first portion 312*a* and the second portion 312*b* each comprise a material that supports a strip of hook-and-loop fastener.

The second lateral adjustable side closure 313 includes a first portion 313*a* of the lateral adjustable closure 313, which is interconnected to the long back band 324 and a second portion 313*a* of the lateral adjustable closure 313 is interconnected to a second short side band 323. The first portion 313*a* of the lateral adjustable closure 313 further includes a handle regions, in this embodiment two handle regions 317*a* and 317*b*, for example, in the form of finger holds or loops. The lateral adjustable closure 313 may also be in a form wherein the first portion 313*a* and the second portion 313*b* each comprise a material that supports a strip of hook-and-loop fastener.

Bra 300 further includes a lower band region 326, which may be relatively elastic. For example, the lower band region 326 may be formed from a continuous piece of material that forms the first and second bra cups 318*a* and 318*b*, as well as the first and second shoulder straps 320*a* and 320*b*, the back band 324, and the short side band 322, and may have an elastic strip sewn therein.

The bra 300 may further include fingertip grips 325*a*, 325*b*. In this embodiment, the fingertip grips 325*a*, 325*b* are shown secured to the first portion 312*a* of the first lateral adjustable side closure 312 and the fingertip grips 327*a*, 327*b* are shown secured to the first portion 313*a* of the second lateral adjustable side closure 313. The fingertip grips 325*a*, 325*b* can aid in connecting the first portion 312*a* to the second portion 312*b* of the lateral adjustable side closure 312, as well as to aid in proper positioning of the first portion 312*a* in correspondence to the second portion 312*b* of the lateral adjustable side closure 312, for example, in proper position of the handle regions 316*a*, 316*b* which will correspond to the opposing fingertip grips 325*a*, 325*b*. The fingertip grips 327*a*, 327*b* can aid in connecting the first portion 313*a* to the second portion 313*b* of the lateral adjustable side closure 313, as well as to aid in proper positioning of the first portion 313*a* in correspondence to the second portion 313*b* of the lateral adjustable side closure 313, for example, in proper position of the handle regions 317*a*, 317*b* which will correspond to the opposing fingertip grips 327*a*, 327*b*. The fingertip grips may be a raised or thickened lateral ridge, and may be formed from a polymeric material, for example, silicone.

In this embodiment, the bra 300 is shown with two fingertip grips 325*a*, 325*b* on the first portion 312*a* of the first lateral adjustable side closure 312, and two fingertip grips 327*a*. 327*b* on the first portion 313*a* of the second lateral adjustable side closure 313, but, bra 300 may include one, two, three, four fingertip grips, and so forth on each of the of the first portion 312*a* and the first portion 313*a* of the corresponding lateral adjustable side closures 312, 313.

Figure 9:
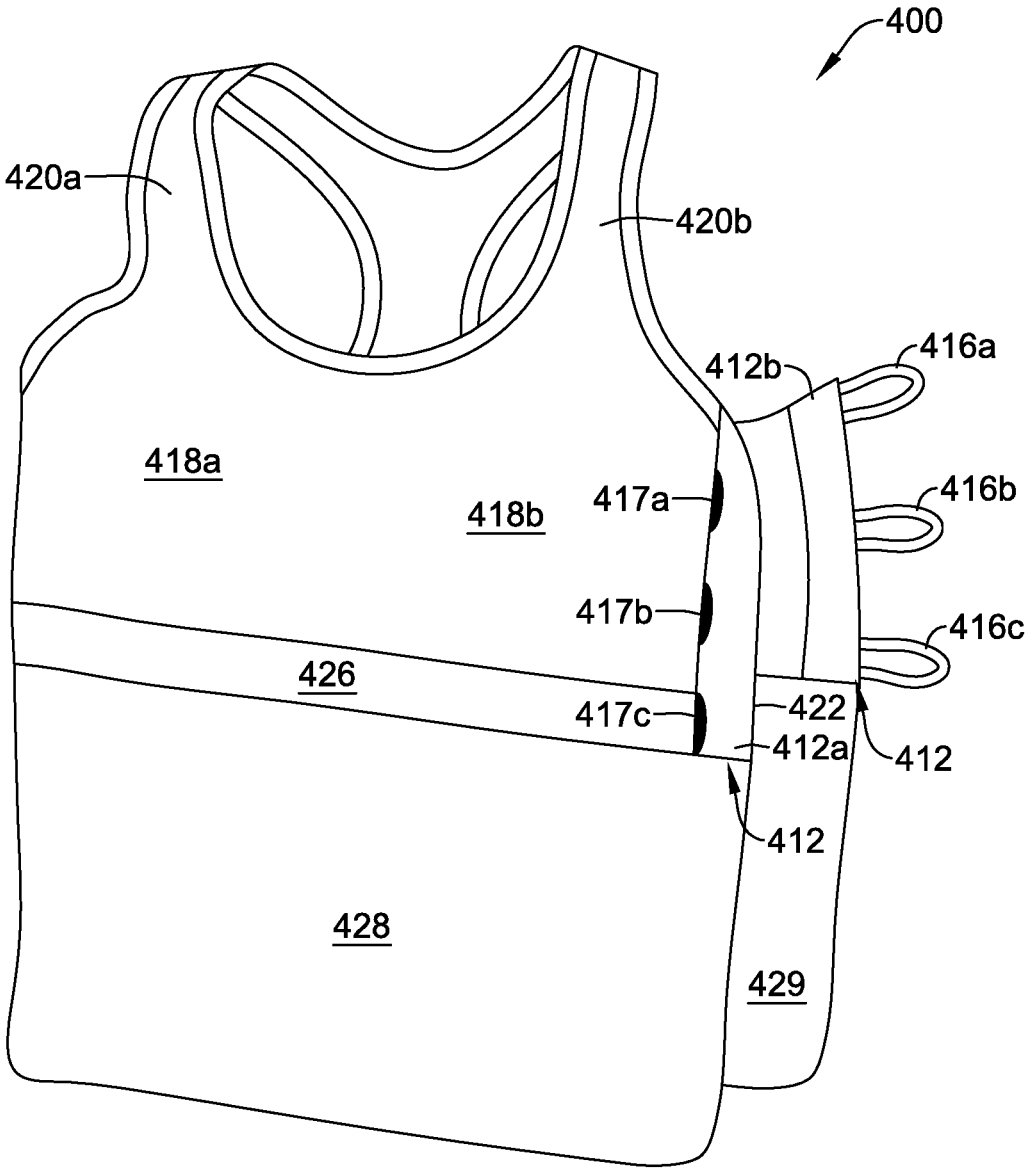
FIG. 9 is a front view of an example garment.

FIG. 9 is a front view of an alternative garment 400 with an attached or incorporated midsection torso panel 428. In this embodiment, the midsection torso panel 428 wraps around the garment 400 to form a back panel 429 such that garment 400 may be worn as a cami, swim top, running garment, shirt, etc. Alternatively, the midsection torso panel 428 could be a separate piece of fabric from the back panel 429, for example, the front of the midsection torso panel 428 may be split from the back of the midsection torso panel 429 at the right side and/or left side of the wearer. Garment 400 includes a first bra cup 418*a* and a second bra cup 418*b* interconnected to a back band (not shown) by a first adjustable shoulder strap 420*a* and a second adjustable should strap 420B. In this embodiment, the first and second shoulder straps 420*a*, 420*b* are shown as being non-adjustably connected to the first and second bra cups 418*a*, 348*b* respectively. The first and second shoulder straps 420*a*, 420*b* may alternatively be adjustably connected to the first and second bra cups 418*a*, 418*b* respectively.

Garment 400 includes a first lateral adjustable closure 412. The lateral adjustable side closure 412 includes a first portion 412*a* of the lateral adjustable closure 412, which is interconnected to the long back band (not shown) and a second portion 412*a* of the lateral adjustable closure is interconnected to a short side band 422. The first portion 412*a* of the lateral adjustable closure 412 further includes a finger grips or holds 417*a*, 417*b*, 417*c*. The second portion 412*b* of the lateral adjustable closure 412 further includes a handle regions, in this embodiment two handle regions 416*a*, 416*b*, and 416*c*, for example, in the form of finger holds or loops. The lateral adjustable closure 412 may be in a form wherein the first portion 412*a* and the second portion 412*b* each comprise a material that supports a strip of hook-and-loop fastener. Again, the number of finger grips or holds, and finger holds or loops may be varied as previously discussed.

Garment 400 further includes a lower band region 426, which may be relatively elastic. For example, the lower band region 426 may be formed from a continuous piece of material that forms the first and second bra cups 418*a* and 418*b*, as well as the first and second shoulder straps 420*a* and 420*b*, the back band (not shown), and the short side band 422, and may have an elastic strip sewn therein.

Garment 400 may be employed for adaptive active clothing apparel, for example, for running, yoga, swimming, and so forth. This list is intended for illustrative purposes only, and not as a limitation on the scope of the present application.

FIGS. 10A-10M illustrate a method of donning an exemplary bra 10. This method is directed at a wearer who is limited to the use of one arm whether due to a surgical procedure or a medical condition. However, this method can be used to don any of the embodiments of the bras disclosed herein, and other methods of donning may also be employed herein. This method is simply illustrative of one way in which the bra 10 can be easily donned. Start out by lying the bra 10 in a wearer's lap with the open side facing the wearer's stomach (not shown in the FIG.s). FIG. 10C shows the wearer's mobile hand. Using the wearer's mobile hand, hook the wearer's thumb under each shoulder strap 20*a*, 20*b* and collect the top of both shoulder straps 20*a*, 20*b* between the thumb and fingers holding shoulder the straps 20*a*, 20*b* together in the now closed hand.

Figure 10A:
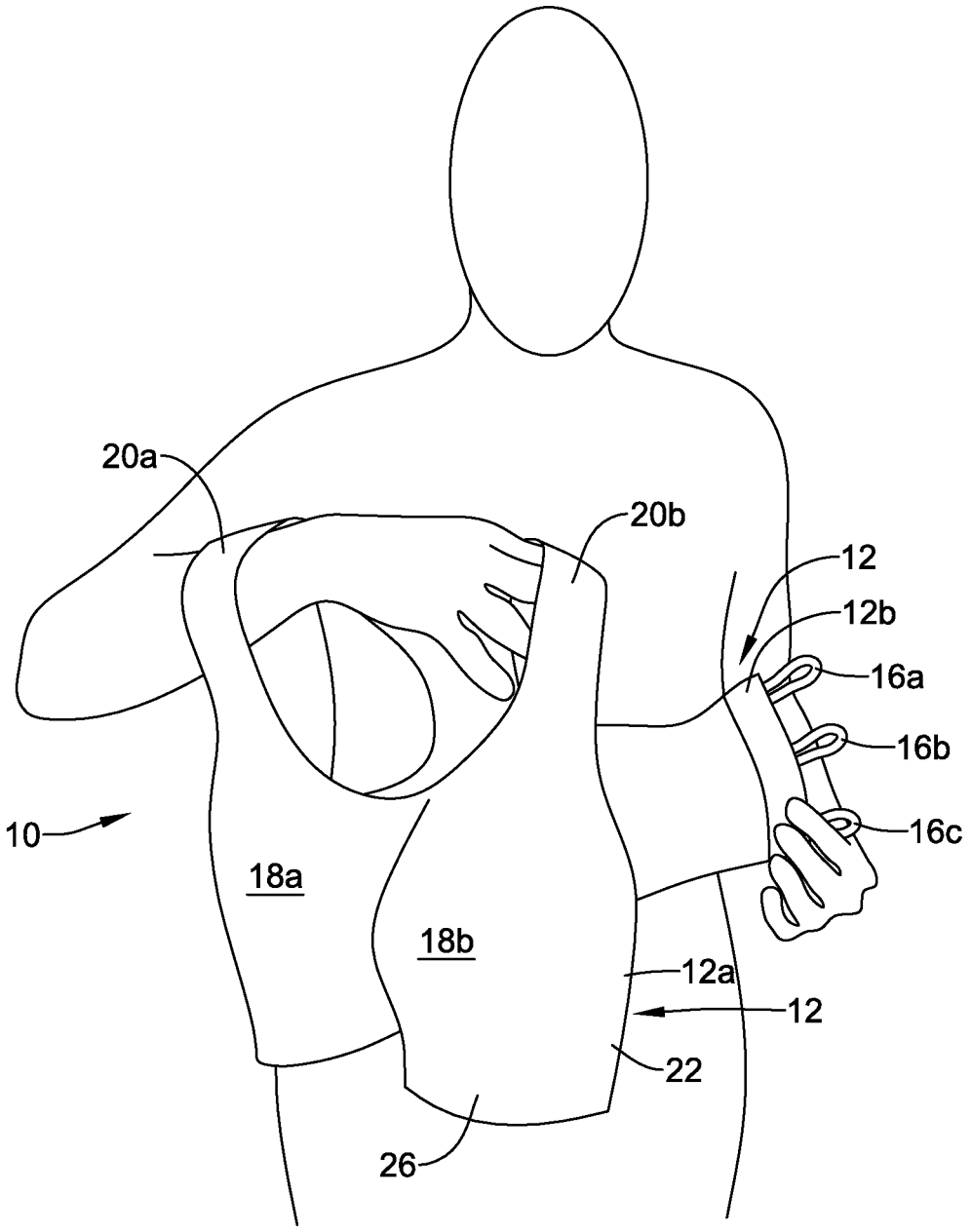
FIGS. 10A-10M illustrate an exemplary method of donning an example bra.
Figure 10B:
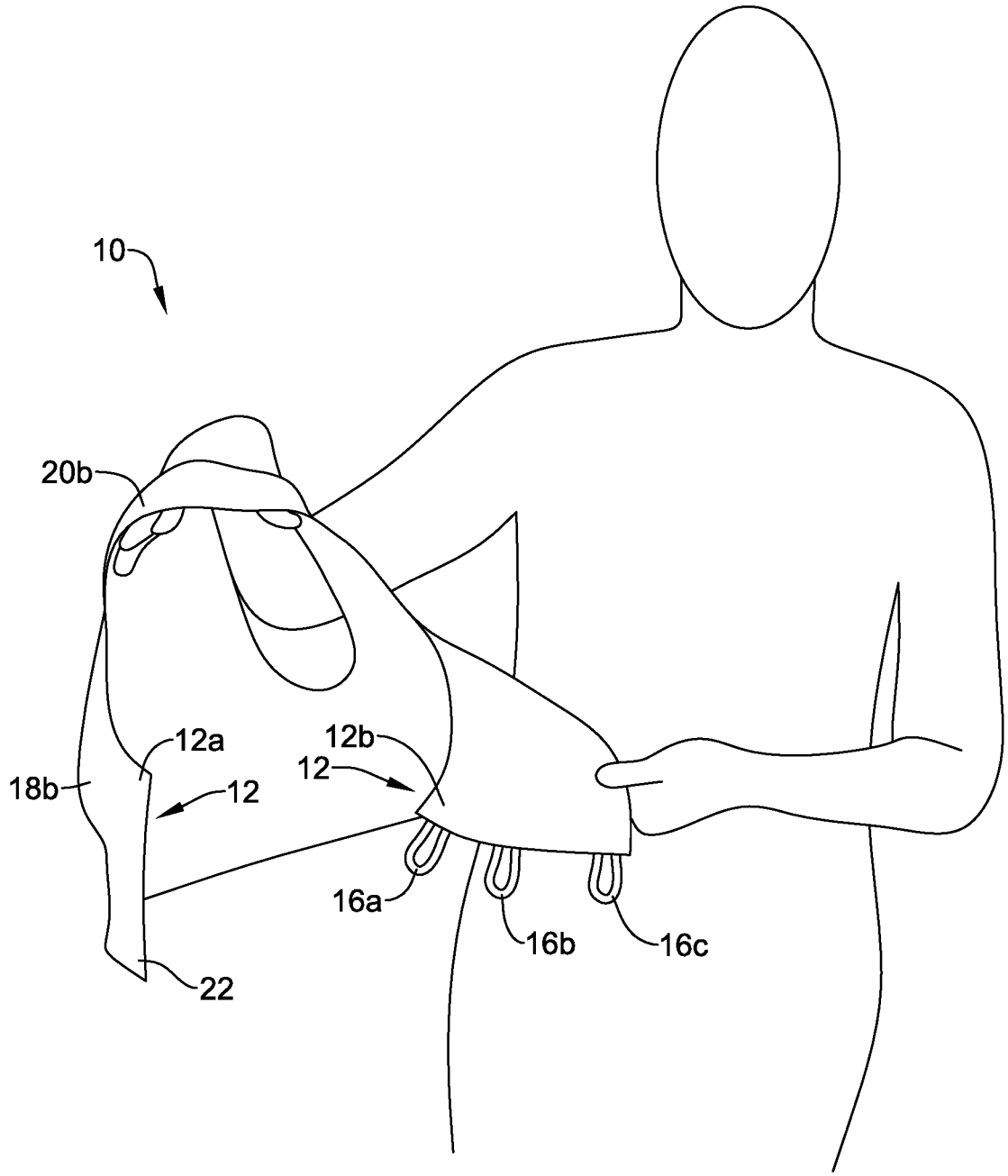
Figure 10C:
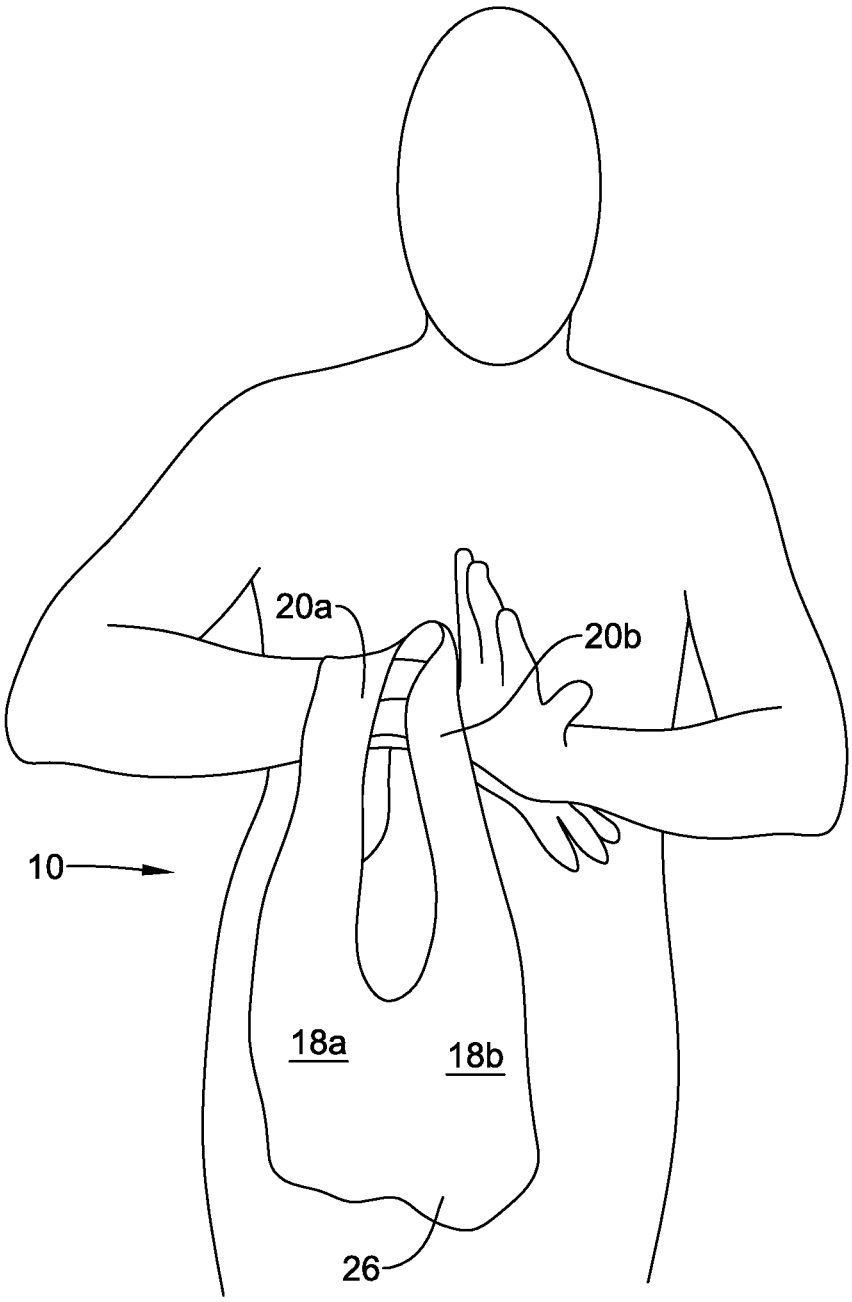
Figure 10D:
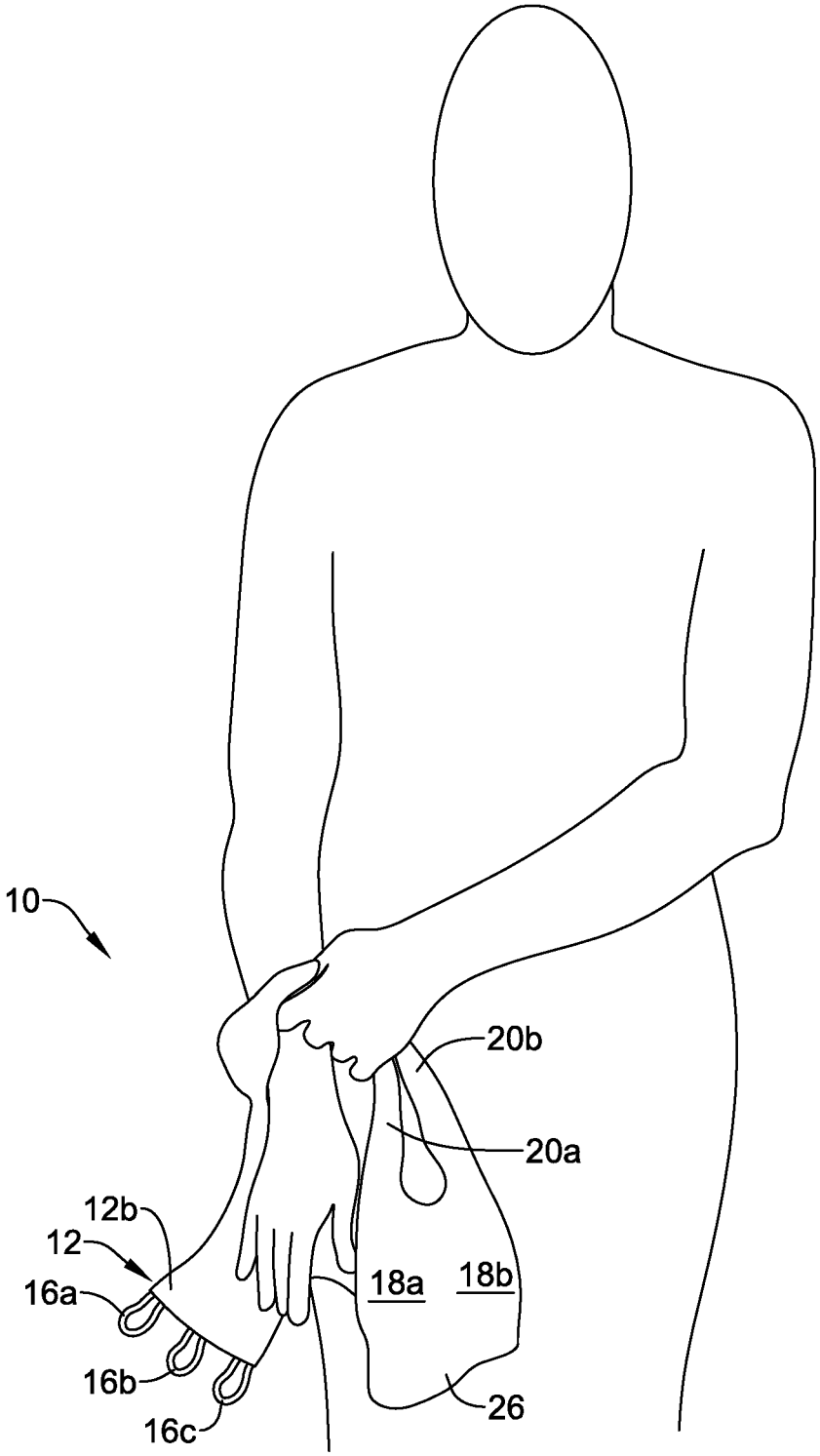
Figure 10E:
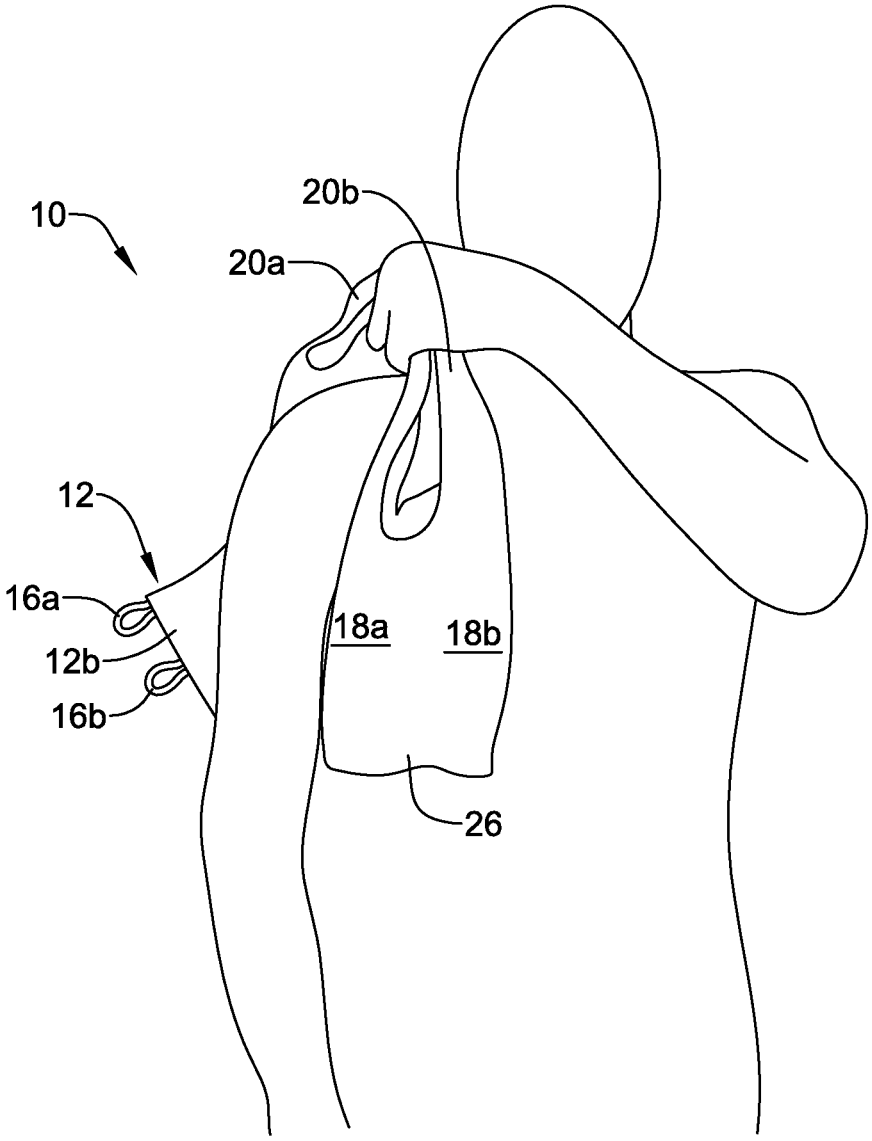

In a first step as shown in FIGS. 10A and 10B, the shoulder straps 20*a*, 20*b* of the bra 10 may be placed on top of wearer's handicapped hand/arm while holding the long back band 24 of the bra 10 in the opposite hand which is the mobile hand. The shoulder straps 20*a* and 20*b* can then be threaded over the handicapped arm/hand while standing or sitting, and moved up to the wearer's shoulder with the opposite hand. The wearer's hand is threaded through the armpit hole as you pull/slide the shoulder straps up towards the wearer's stationary shoulder/armpit as shown in FIGS. 10C-10E.

Figure 10F:
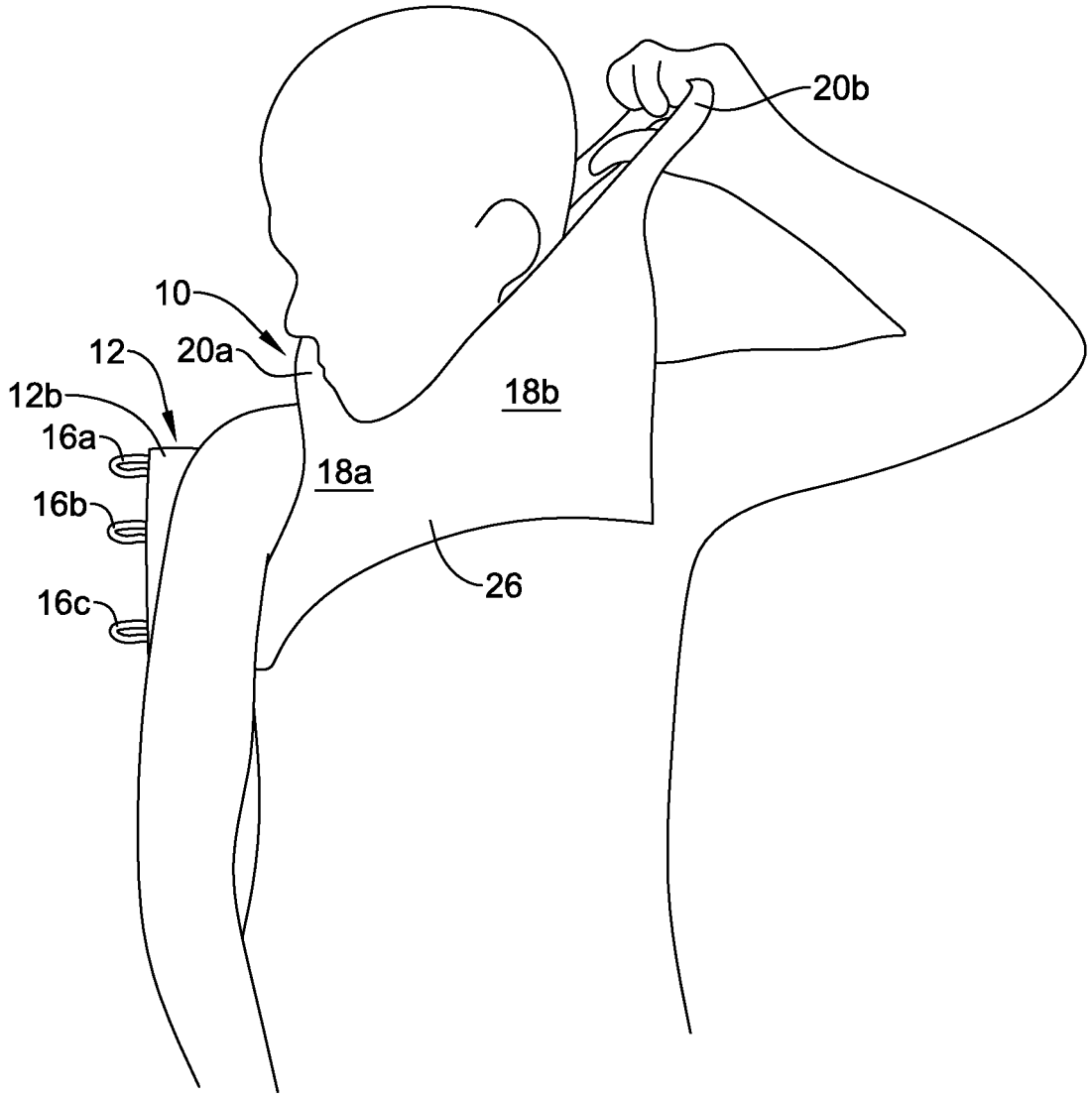
Figure 10G:
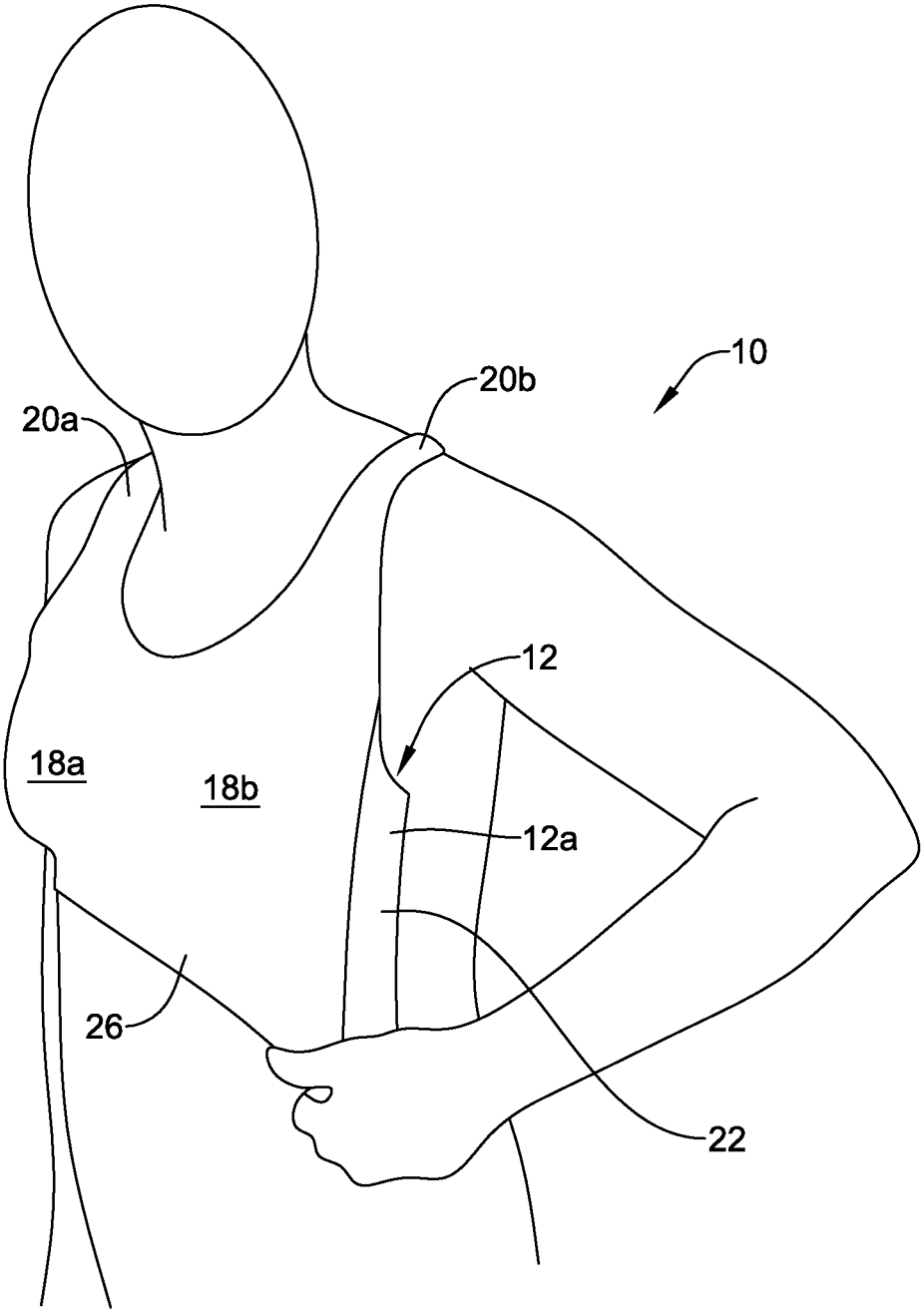

One shoulder strap 20*a* is then left on the shoulder of the stationary arm and one shoulder strap 20*b* is pulled over the wearer's head as shown in FIG. 10F, and the wearer can then pull the bottom band 26 of bra 10 downwards below the wearer's bust/chest area toward the wearer's waist to position the bra 10 in a more comfortable position as shown in FIG. 10G.

Figure 10H:
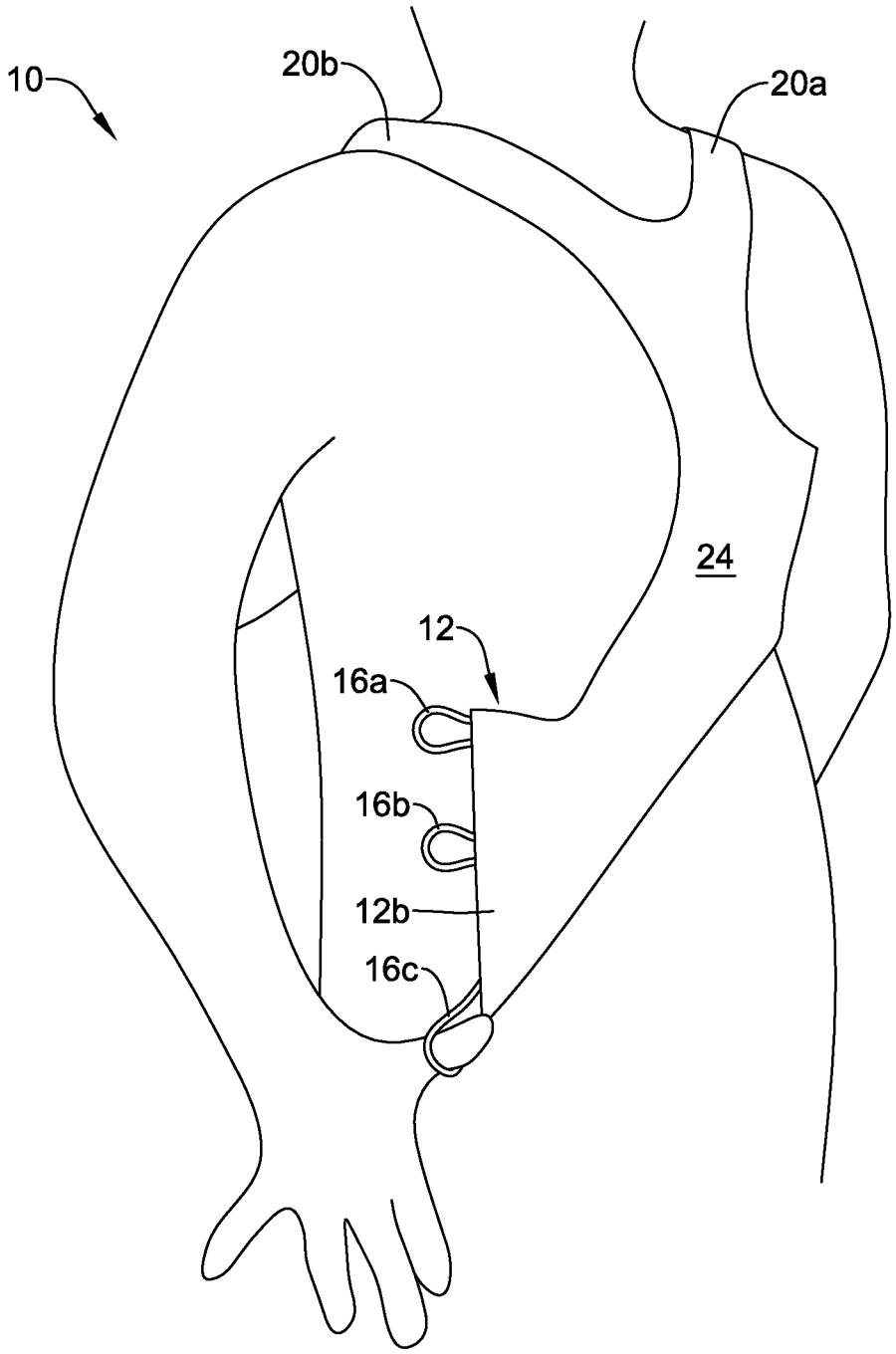

The wearer's moveable hand/arm can then be extended along the wearer's back and a handle region 16*c*, in this embodiment, in the form of a finger loop or fingertip holds, can be grasped with the hand and the thumb may be looped through the handle region 16C of the first portion 12*a* of the lateral adjustable closure 12. The first portion 12*a* of the lateral adjustable closure 12 of the long back band 24, can be pulled toward the second portion 12*b* of the short band 26 of the lateral adjustable closure 12*a* as shown in FIG. 10H. With the wearer's thumb of the moveable hand/arm hooked in the handle region 16*c*, the first portion 12*a* of the lateral adjustable closure 12 can then be mated with the second portion 12*b* of the lateral adjustable closure 12 with the fingertip hold 16*c*, as shown in FIG. 10I, in this embodiment, a hook-and-loop or Velcro to secure the bra 10 in place.

Figure 10I:
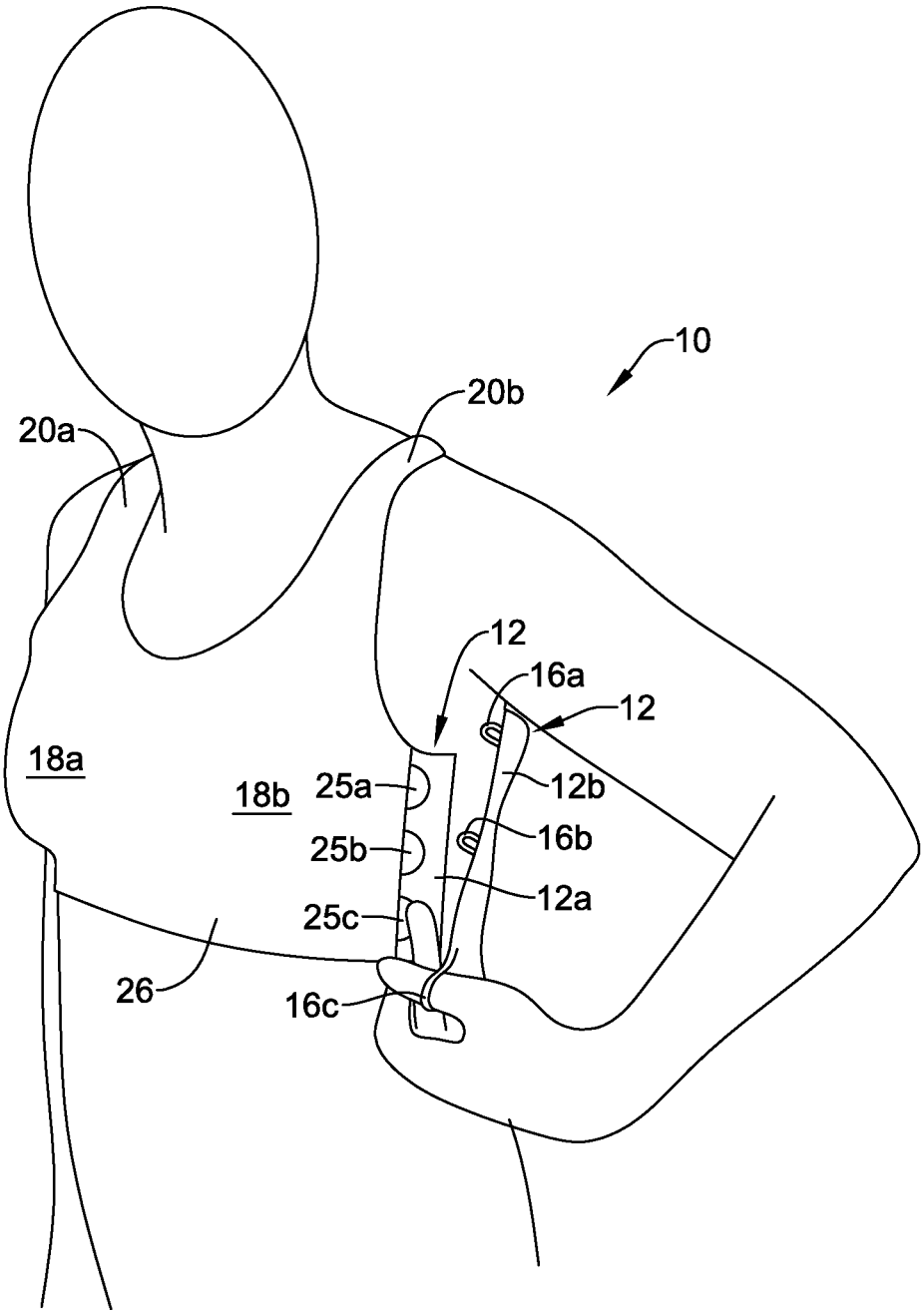

Also, as shown in FIG. 10I, the bra 10 may further include fingertip grips 25*a*, 25*b*, 25*c*. The fingertip grips 25*a*, 25*b*, 25*c* can aid in connecting the first portion 12*a* to the second portion 12*b* of the lateral adjustable side closure 12, as well as to aid in proper positioning of the first portion 12*a* in correspondence to the second portion 12*b* of the lateral adjustable side closure 12, for example, in proper position of the plurality of handle regions 16*a*, 16*b*, 16*c* which will correspond to the opposing fingertip grips 25*a*, 25*b*, 25*c*.

Figure 10J:
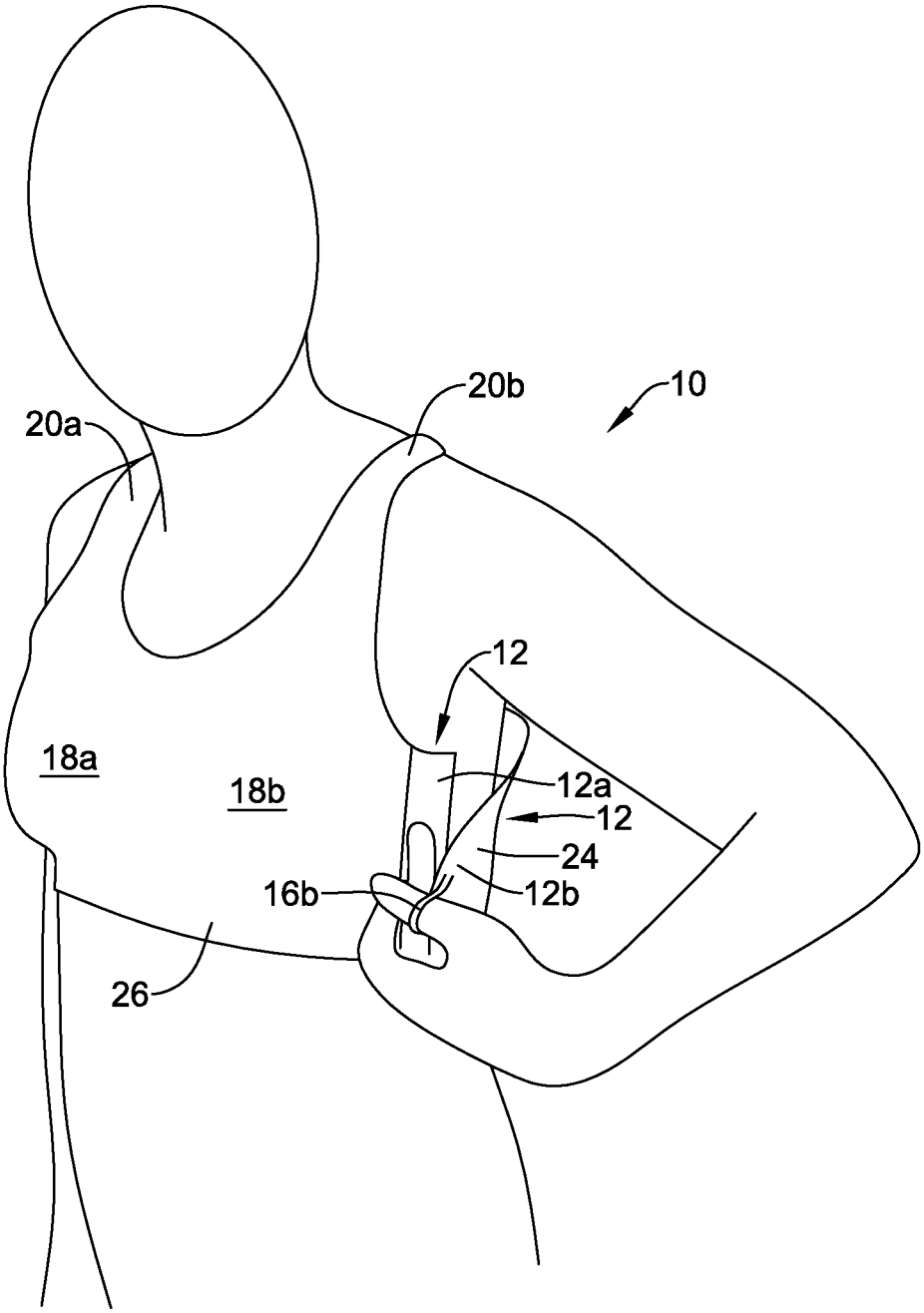
Figure 10K:
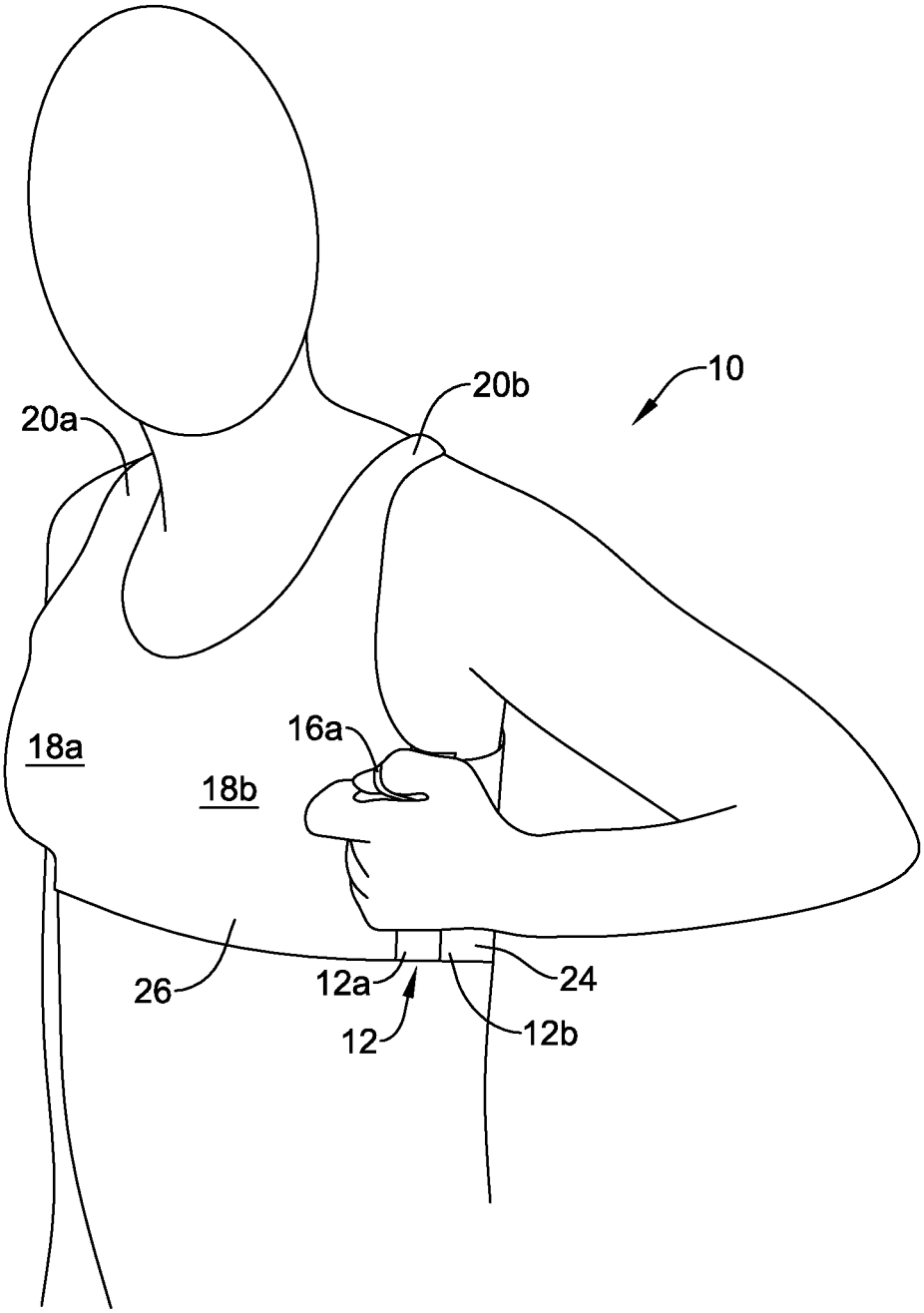
Figure 10L:
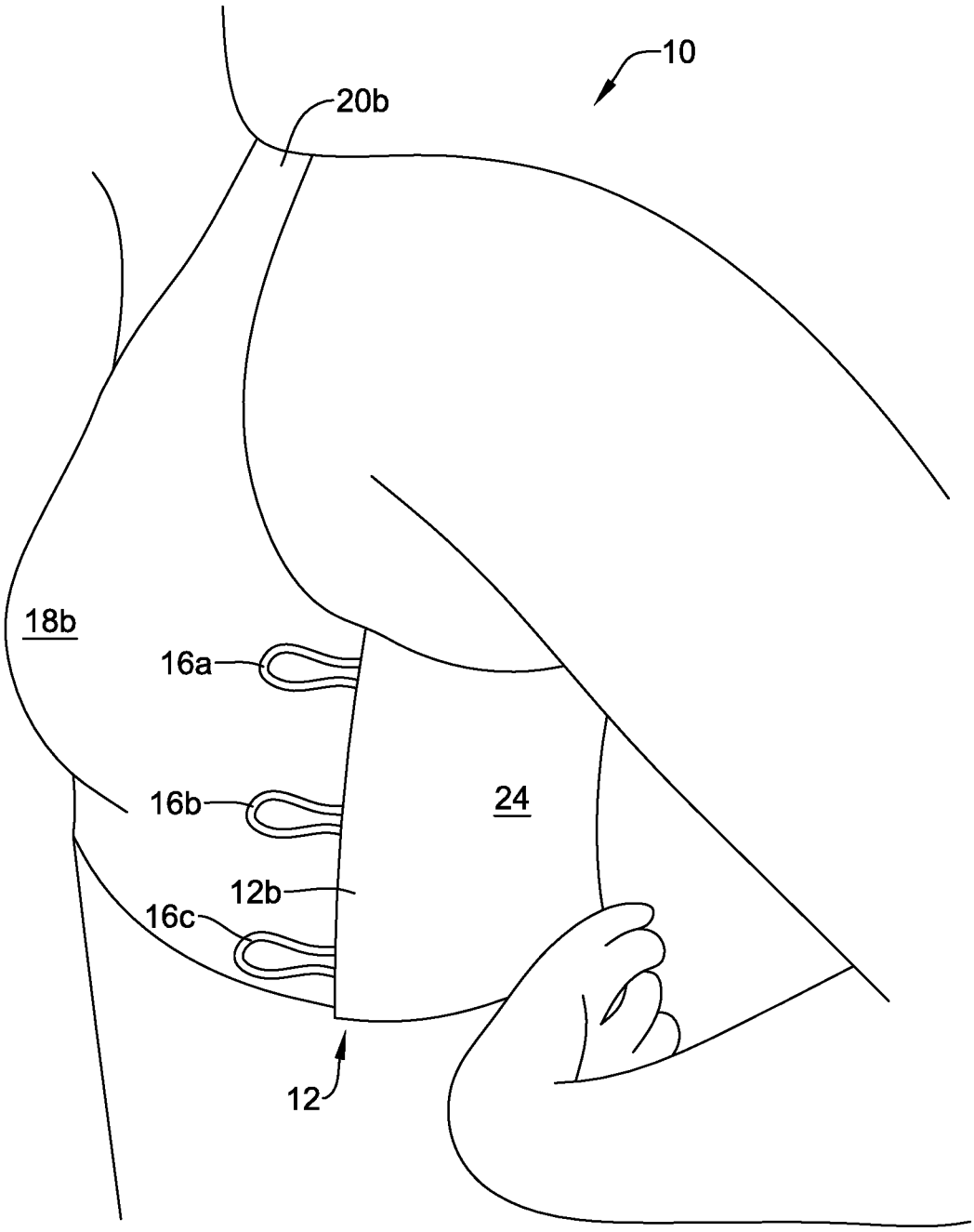
Figure 10M:
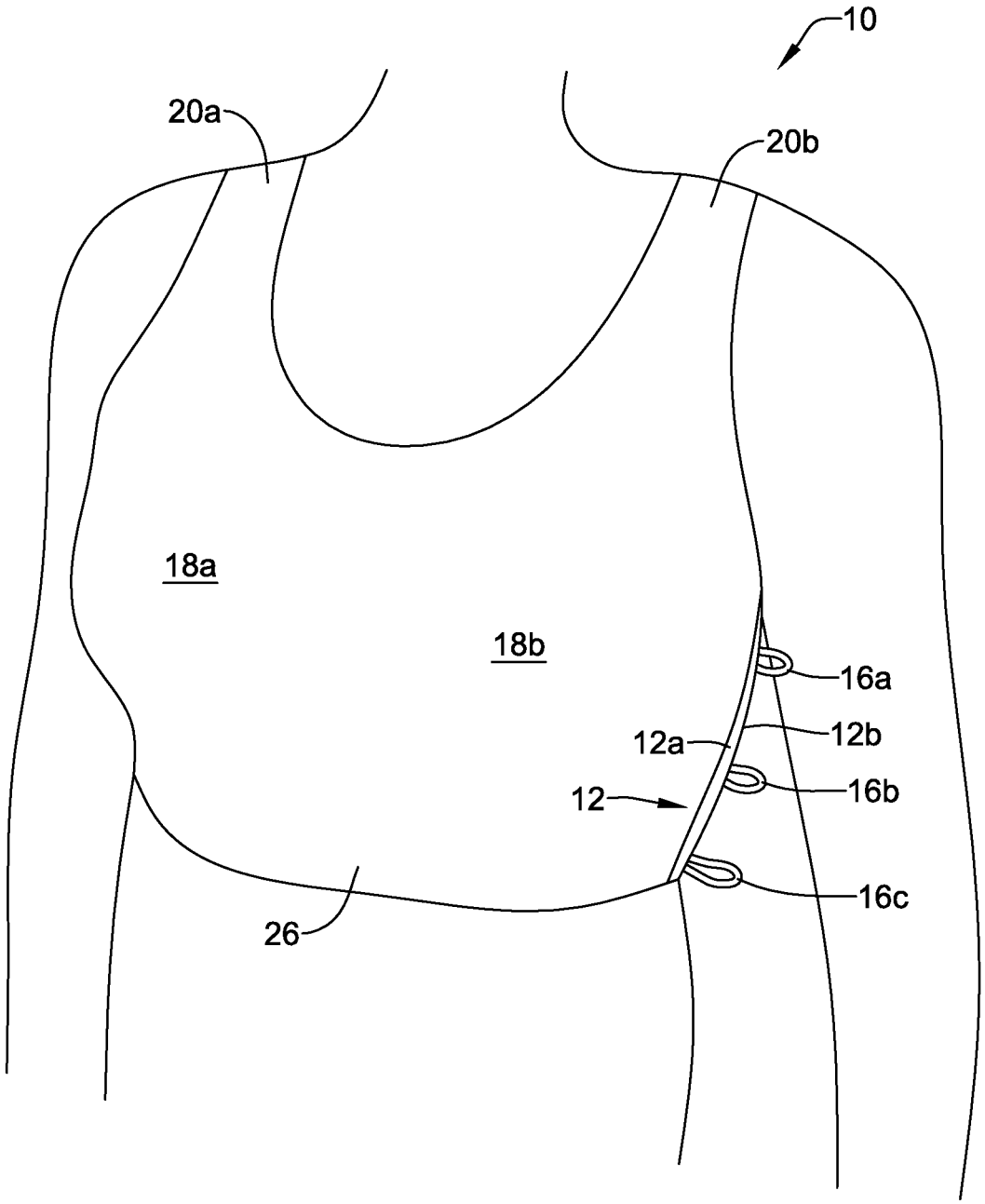

The wearer's thumb of the moveable hand/arm can then be moved up to the next handle region 16*b*, to further pull the first portion 12*a* and the second portion 12*b* of the lateral adjustable closure 12 into place as shown in FIG. 10J. This procedure can then be repeated with the third handle region 16A to completely close the lateral adjustable closure 12 into place as shown in FIGS. 10K and 10L. The handle regions 16*a*-16*c* can then be looped together to form a neat lateral adjustable closure as shown in FIG. 10M.

The breast tissue of the wearer can then be fully enclosed in the bra cups 18*a* and 18*b* by sliding the wearer's movable hand down through the top of the bra cups and pulling the breasts up into each cup 18*a* and 18*b*. The wearer's side tissue of the breast can also be moved up such that the sides of the bra 10 are anchored next to the wearer's ribcage.

The moveable hand of the wearer can then be placed at the back band 24 of the bra 10 and pulled down so the bra 10 is positioned straight across the wearer's back ribcage and not hung up on the wearer's shoulder blades to ensure a comfortable fit.

Other features may also be added to the bra including, but not limited to, those discussed in FIGS. 11-20 below.

Figure 11:
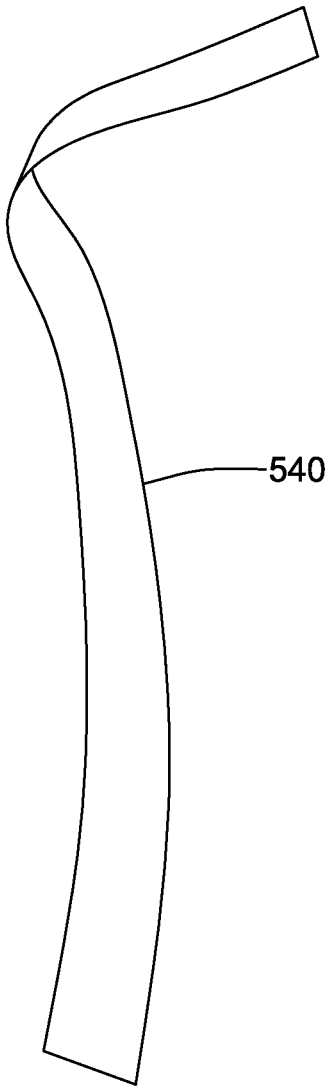
FIG. 11 is a perspective view of an embodiment of a center tie.

FIG. 11 is a perspective view of an embodiment of a center tie 540. The center tie 540 may be formed from any fabric or cording in any way by incorporating loops and/or clamps which allow variable height adjustment to the center cup portion of the bra 50.

Figure 12:
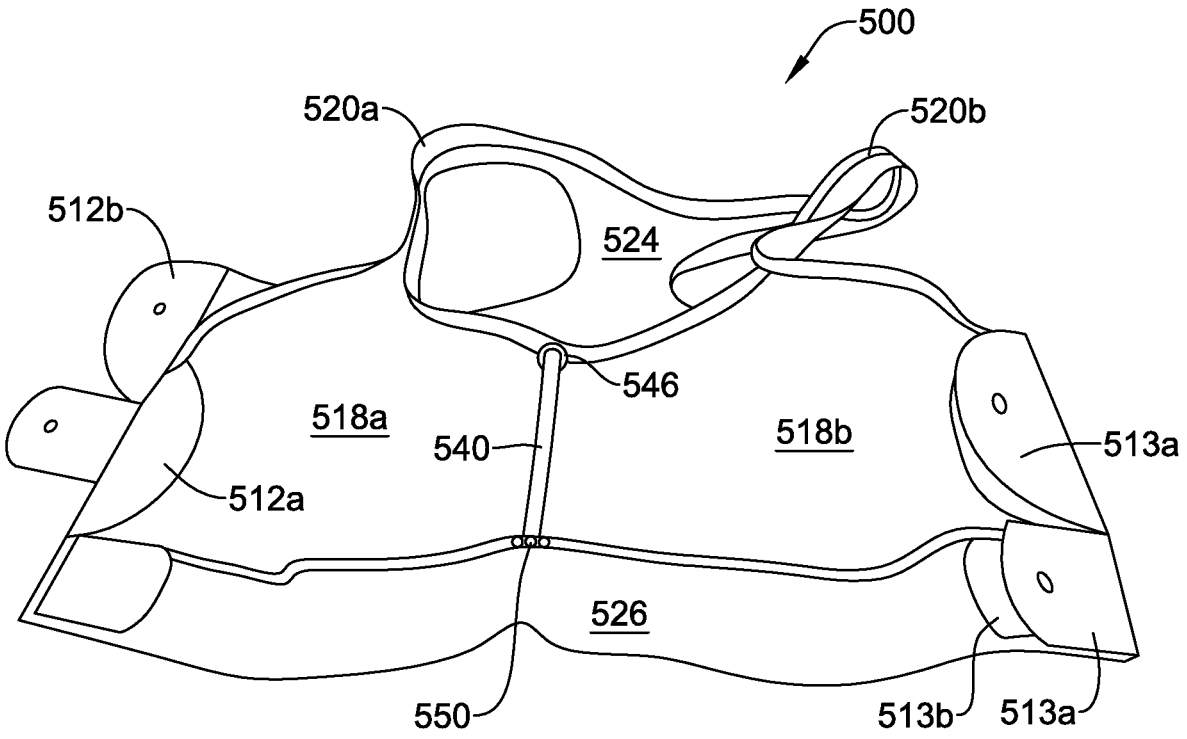
FIG. 12 is front view of a bra illustrating an embodiment of a center tie.
Figure 13:
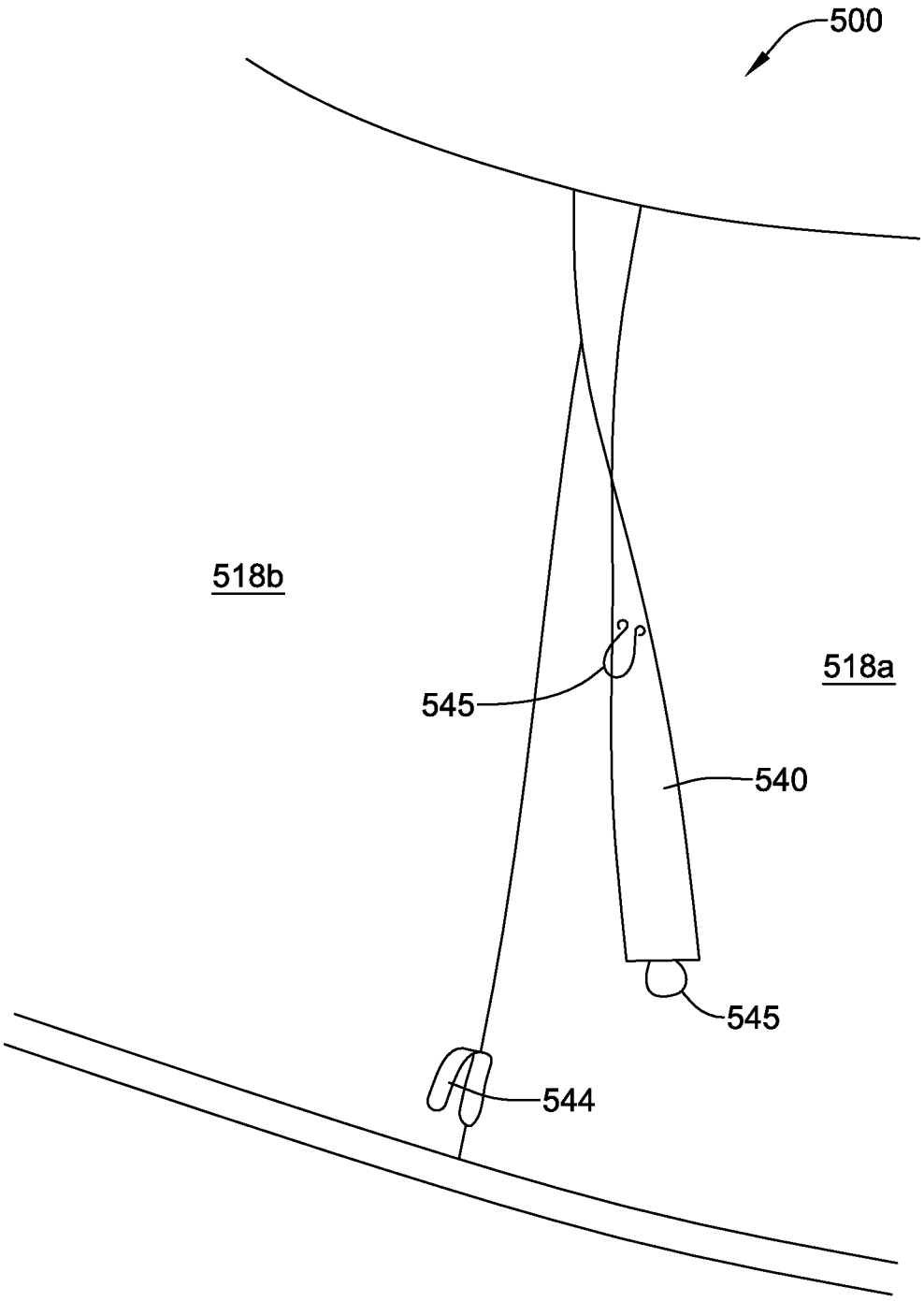
FIG. 13 is a back view of a bra similar to that shown in FIG. 12 illustrating an embodiment of an adjustable center tie in an unsecured position.
Figure 14:
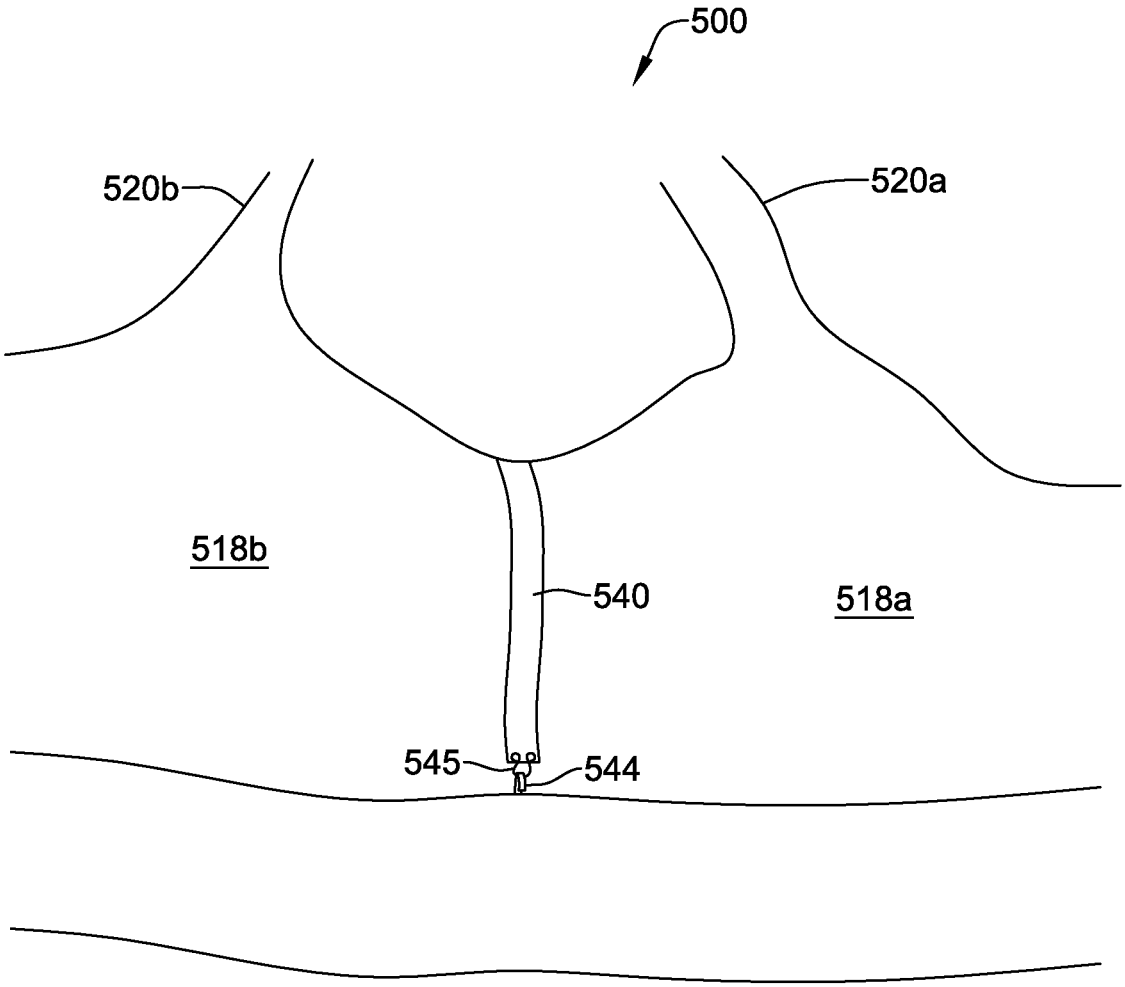
FIG. 14 is a back view of a bra similar to those shown in FIGS. 12 and 13 illustrating an embodiment of an adjustable center tie in a secured position on the bra.

For example, a fabric and a bias tape can be employed to form the center tie 540. As shown in the embodiment in FIG. 12, the same fabric from which the bra 500 is formed can be used to form the center tie 540. In the embodiment shown in FIGS. 11 and 12, three eyelet hooks 545 are sewn onto the bias tape. One eyelet hook 545 is sewn into the top section of the center tie 540, one eyelet hook 545 is sewn into the middle section of the center tie 540, and one eyelet hook 545 is sewn into the bottom section of the center tie 540 as shown in FIG. 13. FIG. 13 illustrates the center tie 540 prior to securement to the bra 500. The center tie 540 may be fed through an opening, for example, button hole, an eyelet 546, or button hole at the top and center of the bra between bra cups 518*a* and 518*b* as shown in FIG. 12. FIG. 14 illustrates the center tie 540 after securement to the bra 500 near the bottom band 526 of bra 500 to a securement member 544. In this embodiment, the center tie 540 is secured with a hook and eye system.

Figure 15:
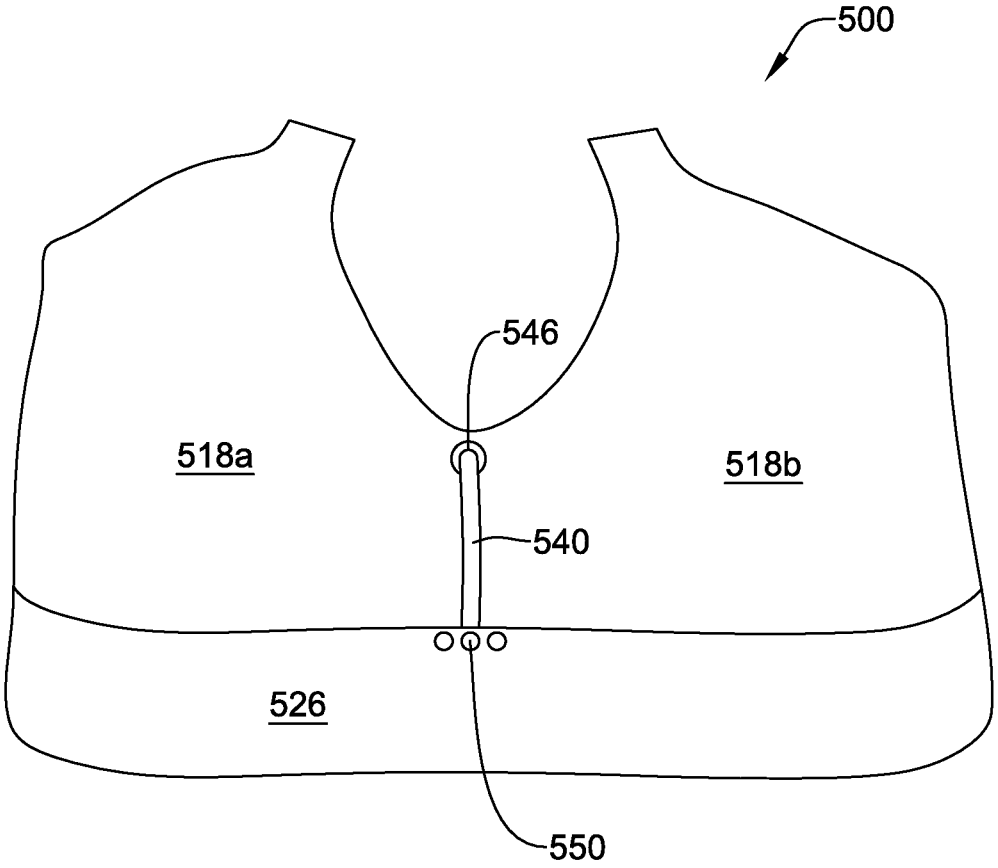
FIG. 15 is an alternative front view of a bra similar to that shown in FIGS. 12-14 illustrating an embodiment of a center tie.

FIG. 15 is an alternative front view of the bra 500 with the center tie 540 secured to the bra 500 near the band 526. Embellishments 550 may be added to improve the stylishness of the bra. For example, rhinestones or other suitable embellishments.

Figure 16:
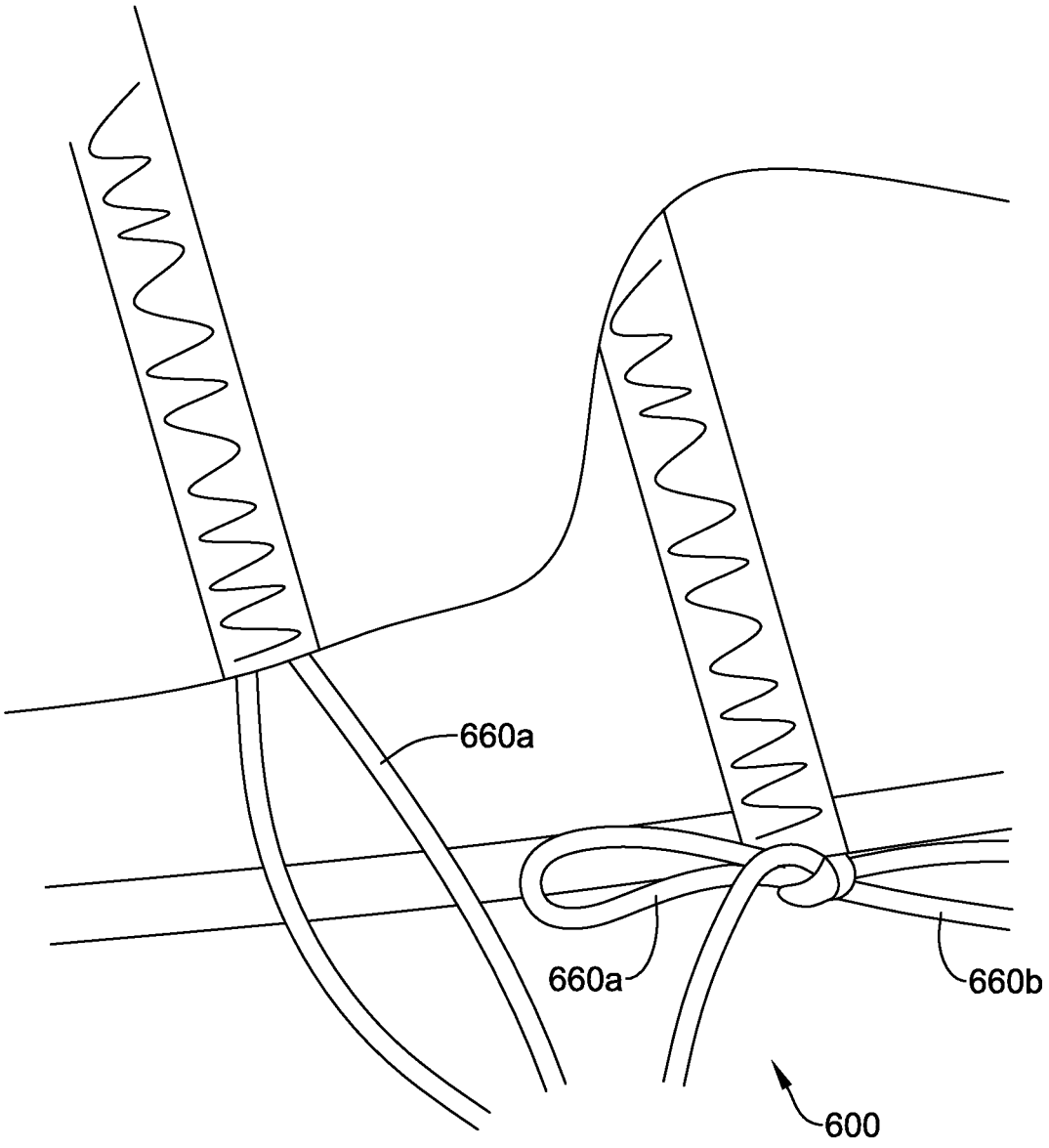
FIG. 16 is a front view of a bra
Figure 17:
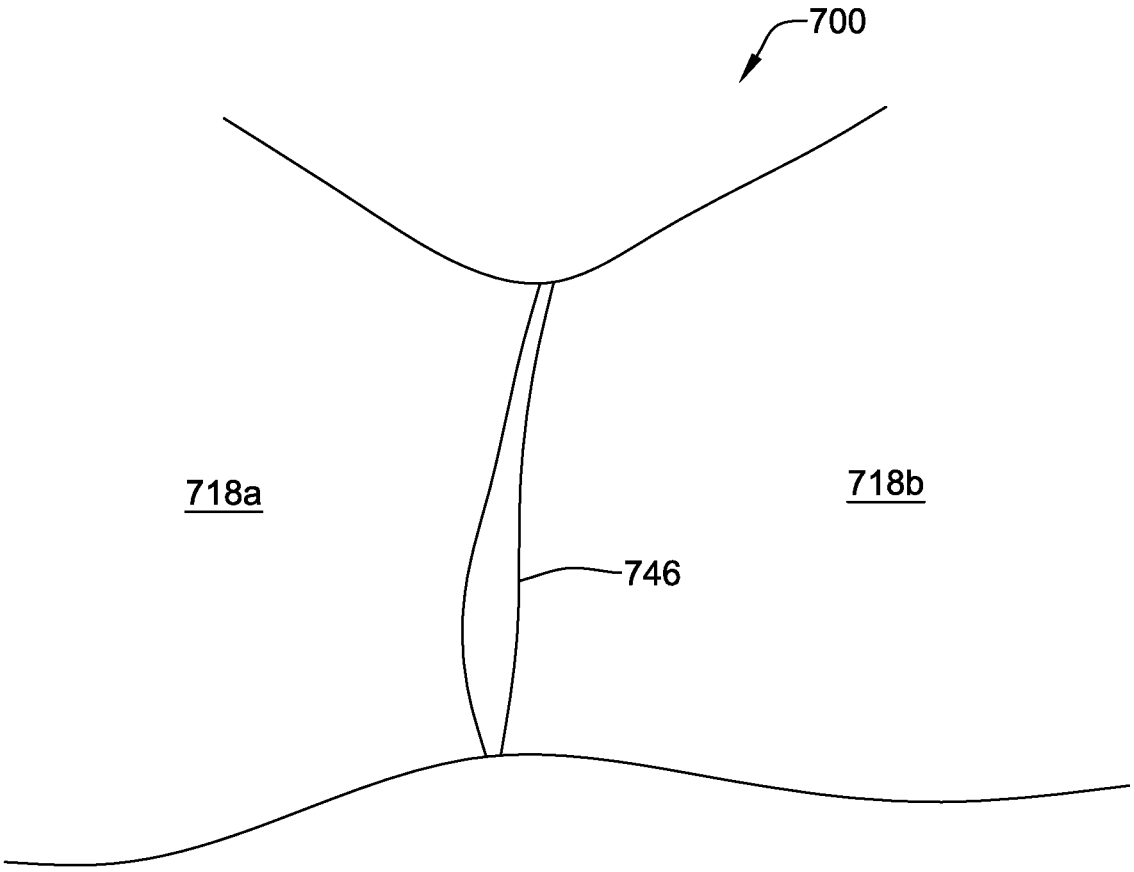
FIG. 17 is a front view of a bra illustrating an alternative embodiment of an adjustable center tie in an unsecured position.
Figure 18:
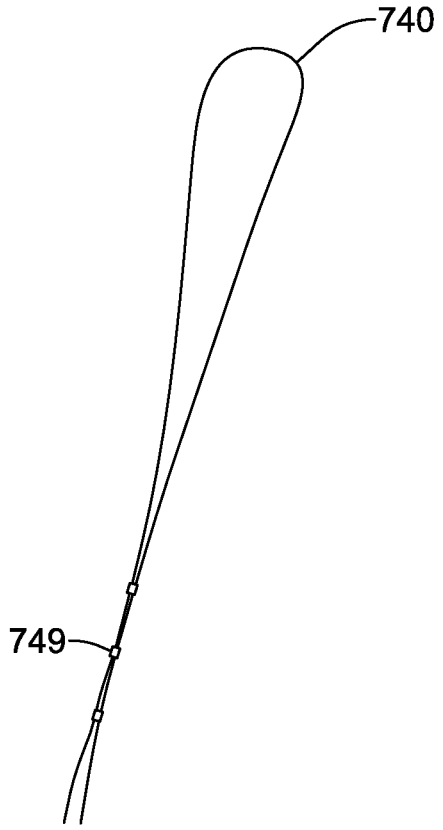
FIG. 18 is a perspective view of an embodiment used for a center tie similar to that shown in FIG. 17.
Figure 19:
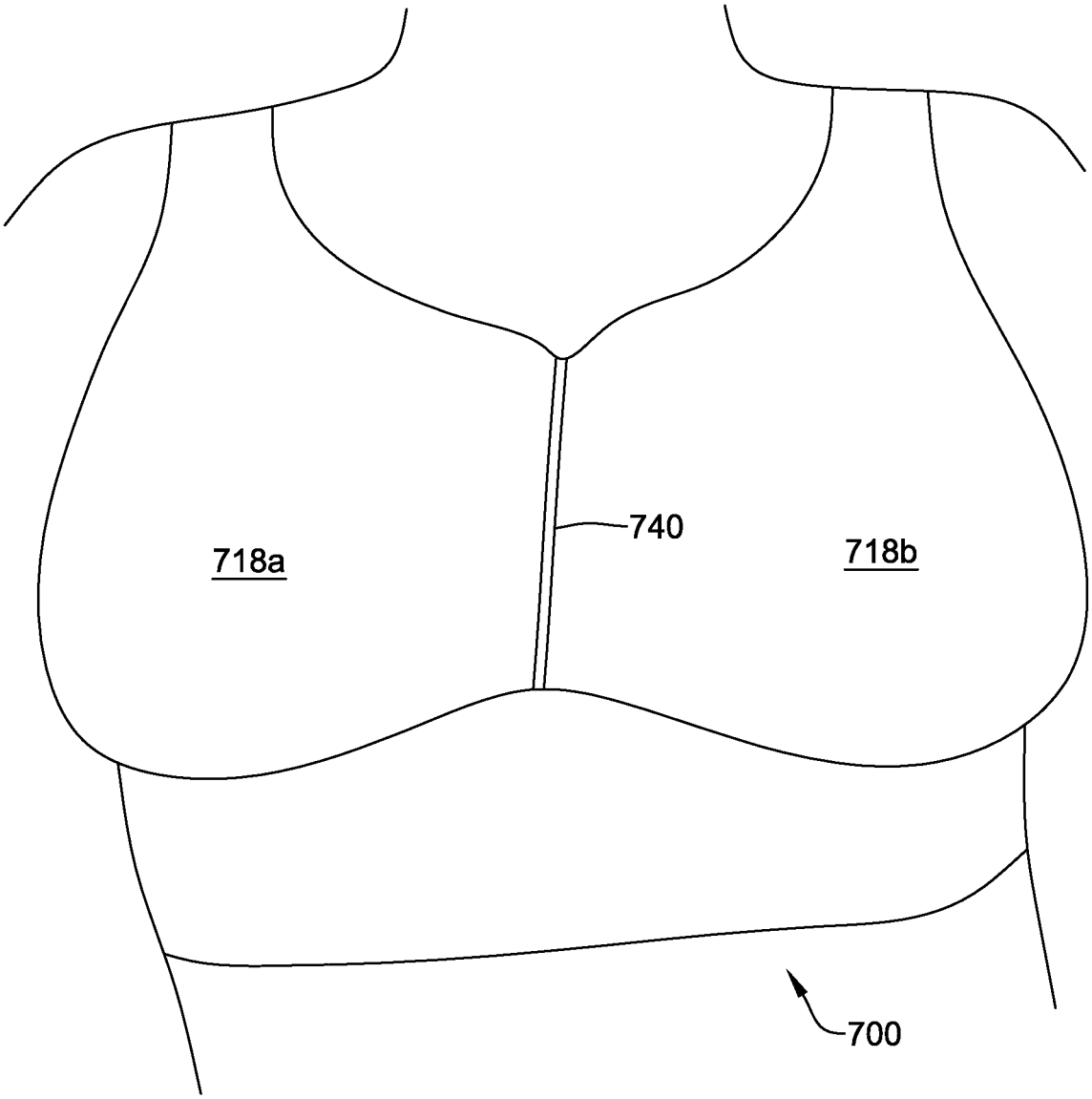
FIG. 19 is a front view of a bra illustrating an alternative embodiment of an adjustable center tie similar to that shown in FIG. 17 in an secured position on the bra.

Other means of securement that reduce the bra cups 518*a* and 518*b* can be contemplated. For example, buttons and button holes, pull ties 660*a* and 660*b* as shown in FIG. 16, and a center cord cup reducer 740 as shown in FIGS. 17-19. Moreover, the number of securement means can be varied, for example, one, two, three, four or more securement means can be added to either the center tie 540 and 740.

FIG. 17 is a front view of a bra 700 illustrating an alternative embodiment of an adjustable center tie 740. In this embodiment, center tie 740 is in the form of cord that forms a loop section that will be secured to the front of bra 700. The loop section as shown in FIG. 18 is secured at three positions with the use of clamp 749 which forms smaller loops in the center tie 740. At each position defined by clamp 749, the upper loop of the center tie 740 may be secured to securement means (not shown) on the interior of the front center band and bra cups 718*a*, 718*b* of the bra 700, for example, with a button or hook. The lower section of the center tie including the clamps 749, may be threaded through a button hole or eyelet where it is freely concealed on the back/inside portion of the bra cups 718*a*, 718*b*. The wearer has the option of securing the center tie 740 at three variable heights provided by the altered heights of the clamps 749 which form multiple smaller loops in the center tie 740 for securing on the interior of the center portion of the bra to a suitable securement means such as a button or hook.

The center tie 740 may be fed through an opening, such as an eyelet, at the top and center of the bra between the bra cups. The loop section of the center tie 740 will be secured to the front of the center cup and the clamp 749 will be secured and concealed on the inside portion of the center bra cups 718*a* and 718*b*. The wearer has capability of adjusting the bra cup height by use of the alternate clamps 749 provided on the concealed portion of the center tie 740.

The loop as shown in FIG. 18 has an upper loop section that is secured to the front center band and bra cup portion. The lower clamp section of the loop is threaded through a button hole where it is freely concealed on the back/inside portion of the bra cups. The wearer has the option of securing the center tie at three variable heights provided by the altered heights of the clamps and loops provided.

FIG. 19 is a front view of a bra 700 similar to that shown in FIG. 17 with center tie 740 secured in position on the interior of the front of the bra 700.

Figure 20:
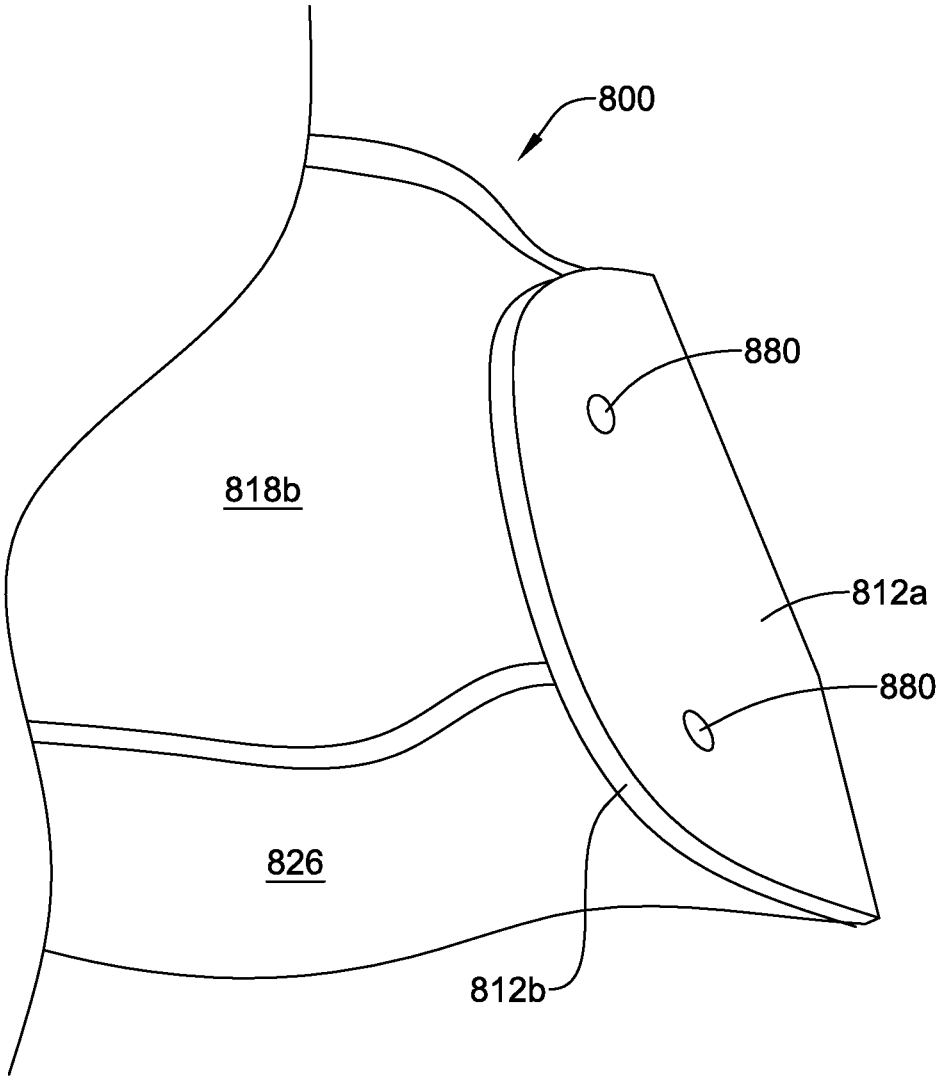
FIG. 20 is a front view of an alternative embodiment of a side closure having an alternative shape with the use of one two or more openings in the side closure.
Figure 21:
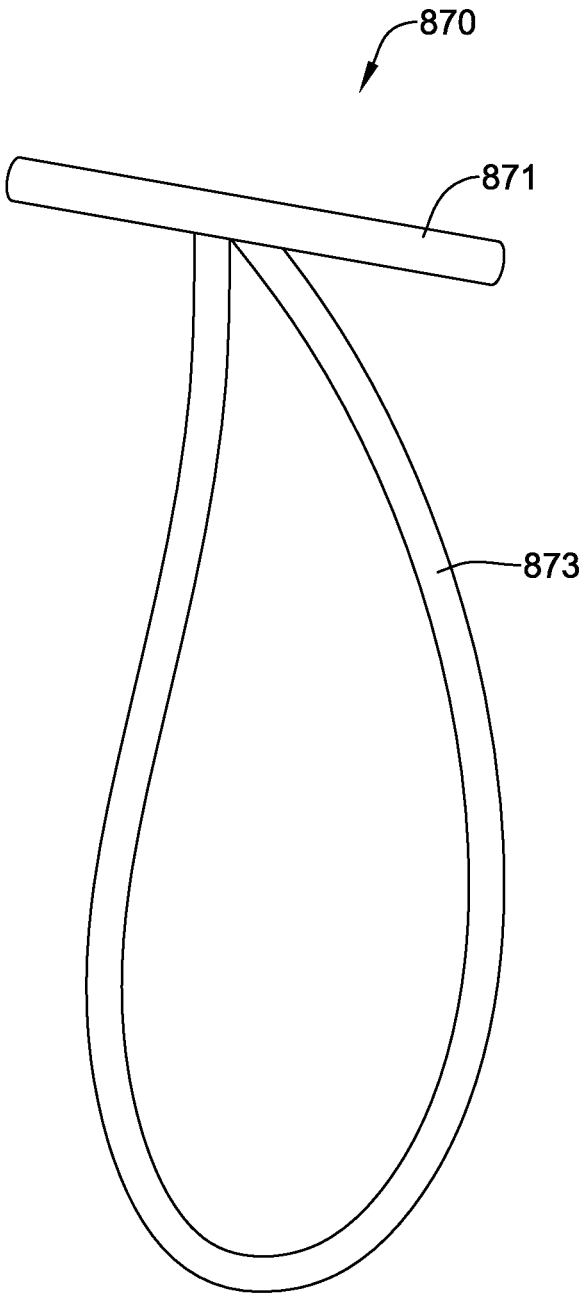
FIG. 21 is a perspective view of a finger hold in the form of an aglet.
Figure 22:
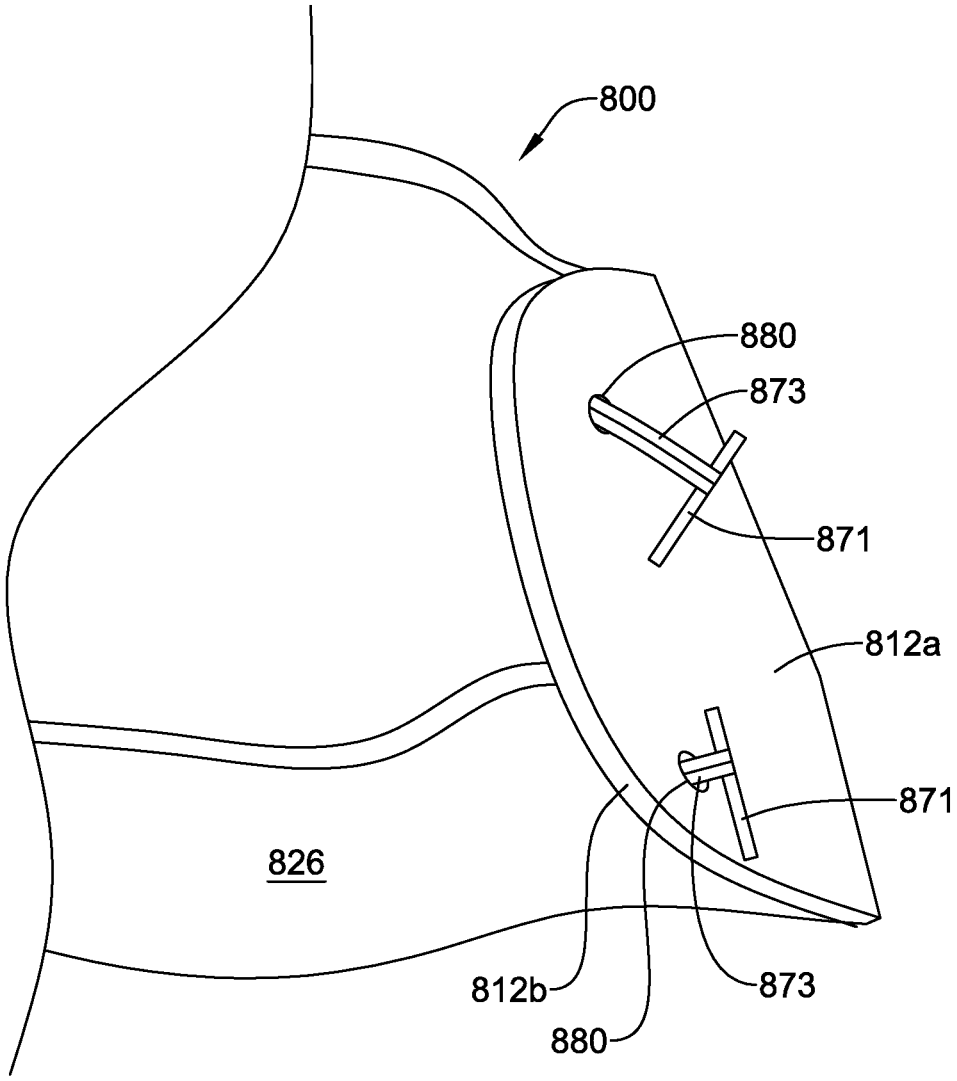
FIG. 22 is a side view of an example bra using a finger hold in the form of an aglet.

FIG. 20 is a front view of an alternative embodiment of a side closure 812 having an alternative shape in the form of a half moon or half ellipse to facilitate ease of bra construction. The first portion 812*a* of the lateral adjustable side closure 812 may be secured in position with a hook and loop system wherein the first portion 812*a* is in the form of a loop and the second portion 812*b* is in the form of a hook system or vice versa. The first portion 812*a* of the lateral adjustable side closure 812 is interconnected to a long back band of the bra 800 and the second portion 812*b* of the lateral adjustable closure 812 is interconnected to a short side band of the bra 800. In some embodiments, the first portion 812*a* of the lateral adjustable side closure 812 will have a hook material, and the second portion 812*b* of the lateral adjustable side closure 812 will have a loop material. In this embodiment, the first portion 812*a* of the lateral adjustable side closure 812 is shown with openings 880. These openings 880 may be used for removable finger holds as shown in FIGS. 21 and 22. The lateral adjustable side closure 812 may include one, two, three or more openings 880 depending on the size of the bra 800. An embodiment of a finger hold 870 is shown in FIGS. 21 and 22 in the form of an aglet. Grommets may alternatively be employed. One, two, three or more finger holds 870 can be employed.

Additionally, included in the embodiment of FIG. 20, is an additional finger grip or hold 817 located on the short side band of the bra 800.

As shown in FIGS. 21 and 22, a metal portion or clasp 871 of the aglet can be pushed through the opening 880 from underneath the first portion 812*a* of the lateral adjustable side closure 812 so the metal clasp 871 is accessible from the top of the first portion 812*a* of the lateral adjustable side closure 812. This allows the aglets 870 to be easily removed from the bra 800 when the wearer is done donning the bra 800. When the aglets 870 are inserted into openings 880 of the first portion 812*a* of the lateral adjustable side closure 812, clasp 870 of the aglet 870 is firmly pressed against the edge openings 880 of the first portion 812*a* of the lateral adjustable side closure 812 to help stabilize the loop 873 of the aglets 870 to prevent them from falling back out of the openings 880 as the bra 800 is being donned.

These examples are intended for illustrative purposes only, and not as a limitation on the scope of the present application.

The brassieres disclosed herein may be formed from any suitable fabric including both natural and synthetic fabrics known in the art for forming brassieres. The materials may include those materials that are breathable and/or those materials that have wicking properties.

Examples include, but are not limited to, cottons; polyesters; synthetic elastanes or Spandex, such as polyurethanes, for example, Lycra®, and polyester-polyurethane copolymers, for example, Spandex®; polyamides (i.e. Nylons); cellulose or viscose, for example, rayons, silks, and so forth.

Blends or layers of these materials may also be employed herein. For example, nylon/Lycra® blends, polyester/Lycra® blends, rayon/Lycra® blends, silk/Spandex blends, cotton/Spandex blends, and so forth.

These example materials are intended for exemplary purposes only, and not as a limitation on the scope of the present disclosure.

It should be understood that this disclosure is, in many respects, only illustrative. Changes may be made in details, particularly in matters of shape, size, and arrangement of steps without exceeding the scope of the disclosure. This may include, to the extent that it is appropriate, the use of any of the features of one example embodiment being used in other embodiments. The invention's scope is, of course, defined in the language in which the appended claims are expressed.

What is claimed is:

1. A brassiere comprising:

a) first and second bra cups, each of said cups including upper, lower, inner side and outer side margins;

b) a chest band connecting said inner side margins of said first and said second bra cup in the front of a wearer;

c) first and second shoulder straps for coupling to the first and second bra cups respectively;

d) a back band that couples to the first and second shoulder straps and to the first and second bra cups, the back band having a first end region;

e) a first short side band that is coupled to at least one of the outer side margins of the first and second bra cups, the first short side band having a first end region;

f) a first reopenable and reclosable lateral side closure formed by coupling the first end region of the first short side band the first end region of the at least one back band at a side of the wearer, and wherein the at least one first end region of the at least one back band comprises at least one handle region;

g) a second short side band coupled to another of the outer side margins of the first and second bra cups, the second short side band having a first end region; and h) a second reopenable and reclosable lateral side closure formed by coupling the first end region of the second short side band to a second end region of the back band, and the second reopenable and reclosable lateral side closure is at an opposite side of the wearer from that of the first reopenable and reclosable later side closure, wherein the second end region of the back band comprises at least one handle region.

2. The brassiere of claim 1, wherein the closure comprises a hook and loop material.

3. The brassiere of claim 1, wherein the at least one handle region comprises a finger loop adapted for pulling the back band of the brassiere to engage the short side band of the at least one first end region.

4. The brassiere of claim 1, further comprising at least two handle regions.

5. The brassiere of claim 1, further comprising at least three handle regions, the at least three handle regions comprising at least three finger loops.

6. The brassiere of claim 1, wherein the at least one handle region comprises a finger loop.

7. A brassiere comprising:

a) a front panel comprising a top, a bottom, a first side and a second side, a first bra cup and a second bra cup, the top of the front panel coupled to a first strap and a second strap, wherein one of the first side and the second side of the front panel is a shorter side;

b) a back panel coupled to the first shoulder strap and the second shoulder strap; and c) at least one reopenable and reclosable lateral side closure formed by coupling a first end region of the at least one short side to a second end region of the at least one back panel at a side of the wearer, and the at least one second end region of the at least one back panel comprising at least one handle region, wherein the at least one handle region comprises a removable finger loop or aglet.

8. The brassiere of claim 7, wherein the closure comprises a hook and loop material.

9. A brassiere comprising:

a) a front panel comprising a top, a bottom, a first side and a second side, a first bra cup and a second bra cup, the top of the front panel coupled to a first strap and a second strap, wherein one of the first side and the second side of the front panel is a short side and one of the first side and the second side is a long side, the long side of the front panel is coupled to the first shoulder strap and the second shoulder strap; and b) at least one reopenable and reclosable lateral side closure formed by coupling a first end region of the at least one short side to a second end region of the at least one back panel at a side of the wearer, and the at least one second end region of the at least one back panel comprising at least one handle region, wherein the at least one handle region comprises a removable finger loop or aglet.

10. The brassiere of claim 9, wherein the closure comprises a hook and loop material.

11. The brassiere of claim 9, comprising at least two handle regions.

12. The brassiere of claim 9, comprising at least three handle regions.

13. The brassiere of claim 9, wherein the finger loop is adapted for pulling by a wearer's finger to couple the long side of the front panel to the short side of the front panel.

14. The brassiere of claim 1, further comprising a center tie in the chest band to allow variable height adjustment to the chest band of the bra.

15. The brassiere of claim 1, further comprising a lower band region that is continuous between the first end region of the first side band and the second end region of the back band of the first reopenable and reclosable lateral side closure.

16. The brassiere of claim 9, further comprising a lower band region that is continuous between the first end region of the first side band and the second end region of the back band of the first reopenable and reclosable lateral side closure.

* * * * *